US011545779B2

(12) United States Patent
Ishii

(10) Patent No.: US 11,545,779 B2
(45) Date of Patent: Jan. 3, 2023

(54) HIGH-SPEED TRANSMISSION CONNECTOR

(71) Applicant: Yamaichi Electronics Co., Ltd., Tokyo (JP)

(72) Inventor: Yoshiharu Ishii, Tokyo (JP)

(73) Assignee: YAMAICHI ELECTRONICS CO., LTD., Tokyo (JP)

( * ) Notice: Subject to any disclaimer, the term of this patent is extended or adjusted under 35 U.S.C. 154(b) by 0 days.

(21) Appl. No.: 17/172,844

(22) Filed: Feb. 10, 2021

(65) Prior Publication Data

US 2021/0257772 A1 Aug. 19, 2021

(30) Foreign Application Priority Data

Feb. 14, 2020 (CN) ..... 202010092841.5

(51) Int. Cl.

| | |
|---|---|
| ***H01R 13/50*** | (2006.01) |
| ***H01R 13/502*** | (2006.01) |
| ***H01R 13/41*** | (2006.01) |
| ***H01R 13/6585*** | (2011.01) |
| ***H01R 13/6597*** | (2011.01) |

(52) U.S. Cl.

CPC ..... *H01R 13/502* (2013.01); *H01R 13/41* (2013.01); *H01R 13/6585* (2013.01); *H01R 13/6597* (2013.01)

(58) Field of Classification Search

CPC .... H01R 13/6471; H01R 24/64; H01R 24/60; H01R 12/724; H01R 13/6585; H01R 13/6461; H01R 12/716; H01R 13/6587; H01R 13/6466; H01R 13/646; H01R 13/6581; H01R 13/658

See application file for complete search history.

(56) References Cited

U.S. PATENT DOCUMENTS

| | | | | |
|---|---|---|---|---|
| 3,569,900 | A * | 3/1971 | Uberbacker | H01R 24/20 439/465 |
| 6,210,218 | B1 * | 4/2001 | Chang | H01R 12/7029 439/79 |
| 10,050,369 | B1 | 8/2018 | Yang | |
| 10,236,645 | B1 | 3/2019 | Yang | |
| 10,855,020 | B1 * | 12/2020 | Phillips | H01R 12/721 |
| 2005/0227520 | A1 * | 10/2005 | Wu | G06K 7/0021 439/159 |

(Continued)

OTHER PUBLICATIONS

European Search Report dated Jun. 24, 2021 in corresponding EP application No. 21156301.0.

*Primary Examiner* — Truc T Nguyen

(74) *Attorney, Agent, or Firm* — Hayes Soloway PC

(57) ABSTRACT

According to an embodiment, a high-speed transmission connector includes: a row of first contacts, a row of second contacts, a row of third contacts, a row of fourth contacts, an upper housing that supports the row of first contacts, a lower housing that supports the row of second contacts, and an inner housing that supports the row of third contacts and the row of fourth contacts. The upper housing, the lower housing, and the inner housing are assembled in such a manner that the upper housing and the lower housing face each other in a vertical direction with a gap therebetween, and the inner housing is accommodated in the upper housing and the lower housing. The gap forms a slot into which a header of a device as a communicating counterpart is to be fitted.

11 Claims, 32 Drawing Sheets

(56) References Cited

U.S. PATENT DOCUMENTS

| | | | | |
|---|---|---|---|---|
| 2015/0280375 | A1* | 10/2015 | Xu | H01R 13/6594<br>439/638 |
| 2018/0115119 | A1* | 4/2018 | Little | H01R 12/00 |
| 2019/0131743 | A1* | 5/2019 | Hsu | H01R 13/405 |
| 2019/0165518 | A1* | 5/2019 | Hsu | H01R 13/6471 |
| 2021/0399484 | A1* | 12/2021 | Mongold | H01R 13/41 |
| 2022/0344854 | A1* | 10/2022 | Huang | H01R 13/405 |
| 2022/0344877 | A1* | 10/2022 | Lin | H01R 13/6471 |
| 2022/0349564 | A1* | 11/2022 | Flynn | F21V 23/001 |

* cited by examiner

FIG. 3 A
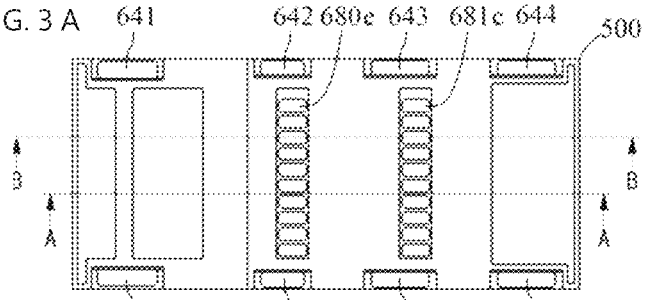
FIG. 3 B
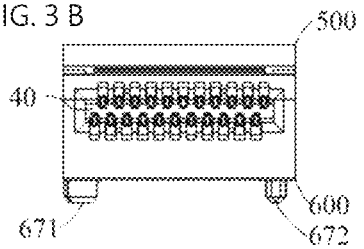
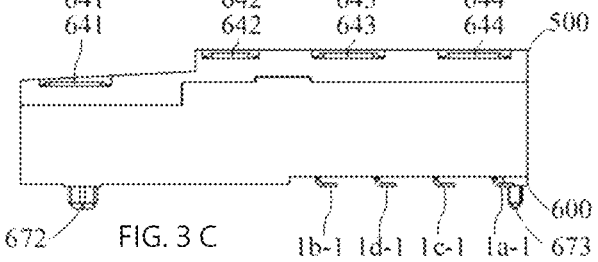
FIG. 3 C
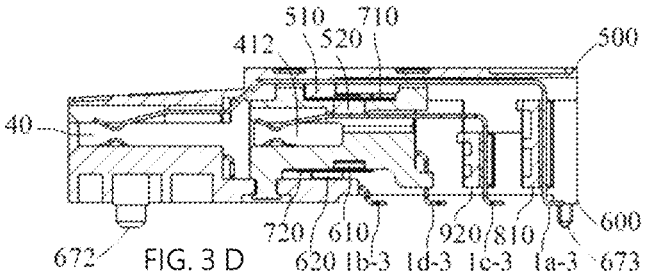
FIG. 3 D
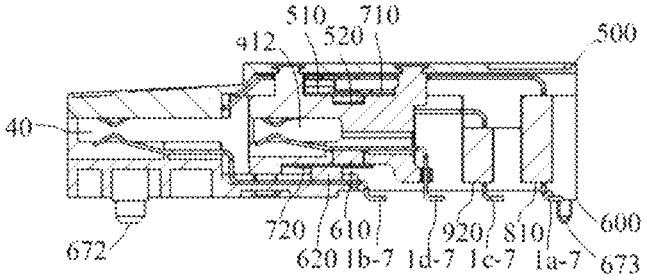
FIG. 3 E

HIGH-SPEED TRANSMISSION CONNECTOR

CROSS-REFERENCE TO RELATED APPLICATION

This application claims the benefit of Chinese Patent application CN202010092841.5 filed on Feb. 14, 2020, the contents of which are incorporated herein by reference herein.

TECHNICAL FIELD

The present invention relates to a high-speed transmission connector mounted on a circuit board.

BACKGROUND

A Quad Small Form Factor Pluggable-Double Density (QSFP-DD) connector has a total of four rows of contacts, upper front and rear rows and lower front and rear rows, in a slot that accommodates a header of a module as a communicating counterpart. The QSFP-DD connector can transmit signals of up to 8 channels at high speed via these 4 rows of contacts. As an example of documents disclosing a technique related to this type of connector, United States Patent Application Publication No. US2019/0131743A1 (hereinafter referred to as "Patent Document 1") can be taken up. The electric connector disclosed in Patent Document 1 includes a laminate of an upper contact module and a lower contact module, which is disposed between a bottom wall and an upper wall facing each other across a fitting slot in the housing, the upper contact module including a first contact and a second contact, and the lower contact module including a third contact and a fourth contact; and contact portions, which are the front ends of the first contact and the second contact, face each other in a vertical direction on the front side in the fitting slot, contact portions, which are the front ends of the third contact and the fourth contact, face each other in a vertical direction on the rear side in the fitting slot, and attachment portions, which are the rear ends of the first to fourth contacts, are exposed downward from an opening under the bottom wall.

However, in the technique of Patent Document 1, since a structure in which the upper contact module and the lower contact module are stacked on the lower wall and fixed by the upper wall is adopted, such a structure has difficulty in part assembling, causing a problem that the dimensional stability and contact reliability are low.

The present invention has been made in view of such a problem, and one of the objects is to provide a QSFP-DD high-speed transmission connector which facilitates part assembling and has high dimensional stability and contact reliability.

SUMMARY

According to an aspect of the disclosure, there is provided a high-speed transmission connector including: a row of first contacts, a row of second contacts, a row of third contacts, a row of fourth contacts, an upper housing that supports the row of first contacts, a lower housing that supports the row of second contacts, and an inner housing that supports the row of third contacts and the row of fourth contacts. The upper housing, the lower housing, and the inner housing are assembled in such a manner that the upper housing and the lower housing face each other in a vertical direction with a gap therebetween, and the inner housing is accommodated in the upper housing and the lower housing. The gap forms a slot into which a header of a device as a communicating counterpart is to be fitted.

BRIEF DESCRIPTION OF DRAWINGS

FIG. 3A is a view of the high-speed transmission connector 6 of FIGS. 1 and 2 as viewed from the +Z side;

FIG. 3B is a view of the high-speed transmission connector 6 of FIGS. 1 and 2 as viewed from the +X side;

FIG. 3C is a view of the high-speed transmission connector 6 of FIGS. 1 and 2 as viewed from the −Y side;

FIG. 3D is a sectional view taken along line A-A in FIG. 3A;

FIG. 3E is a sectional view taken along line B-B in FIG. 3A;

DETAILED DESCRIPTION

Hereinafter, a high-speed transmission connector 6 according to an embodiment of the present invention will be described with reference to the drawings. The high-speed transmission connector 6 is used by mounting it on a circuit board. A header 7 of an optical transceiver 5, which is a communicating counterpart device, is fitted in a slot 40 of the high-speed transmission connector 6. In the following description, a direction in which the high-speed transmission connector 6 is mounted on the circuit board is referred to as a Z direction, a direction in which the optical transceiver 5 is fitted to the high-speed transmission connector 6 is referred to as an X direction, and the direction orthogonal to both the Z direction and the X direction is referred to as a Y direction. Further, a +Z side, which is a side of the high-speed transmission connector 6 in the Z direction, is appropriately referred to as an upper side, and a −Z side, which is a circuit board side, is appropriately referred to as a lower side. Further, a +X side, which is a side of the optical transceiver 5 in the X direction, is appropriately referred to as a front side, and a −X side, which is a side of the high-speed transmission connector 6, is appropriately referred to as a rear side. Further, a +Y side is appropriately referred to as a left side, and a −Y side is appropriately referred to as a right side.

Figure 1:
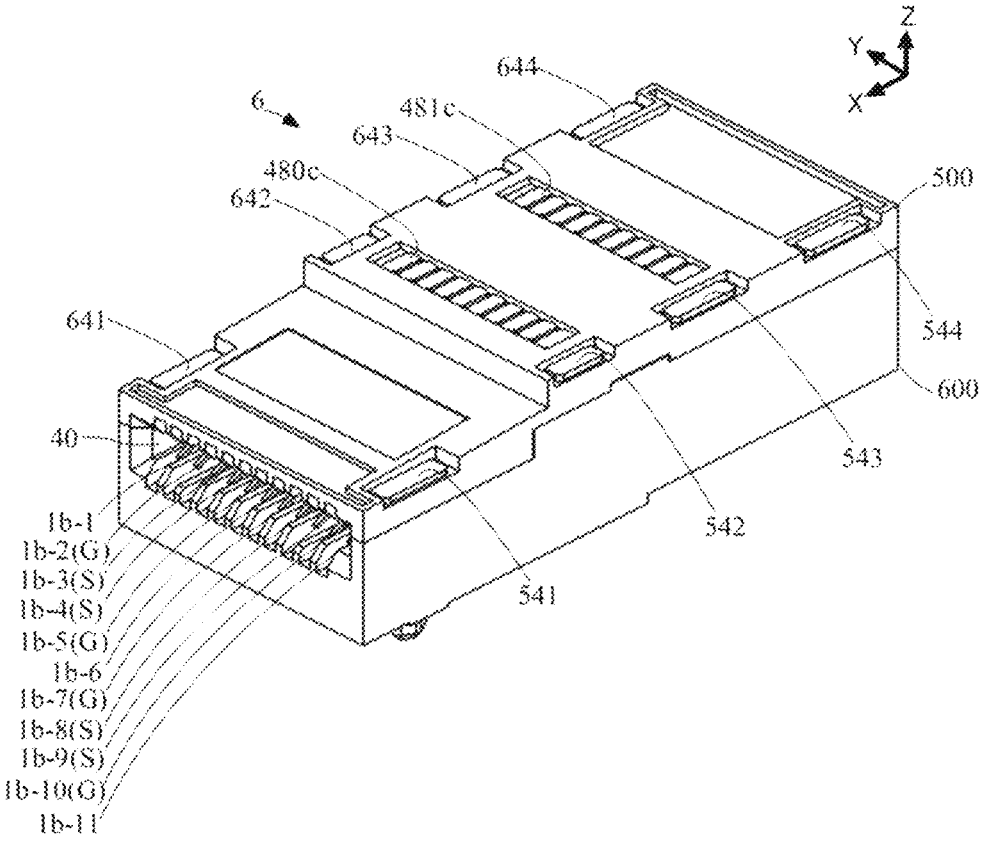
FIG. 1 is a perspective view of a high-speed transmission connector 6 according to an embodiment of the present invention.
Figure 2:
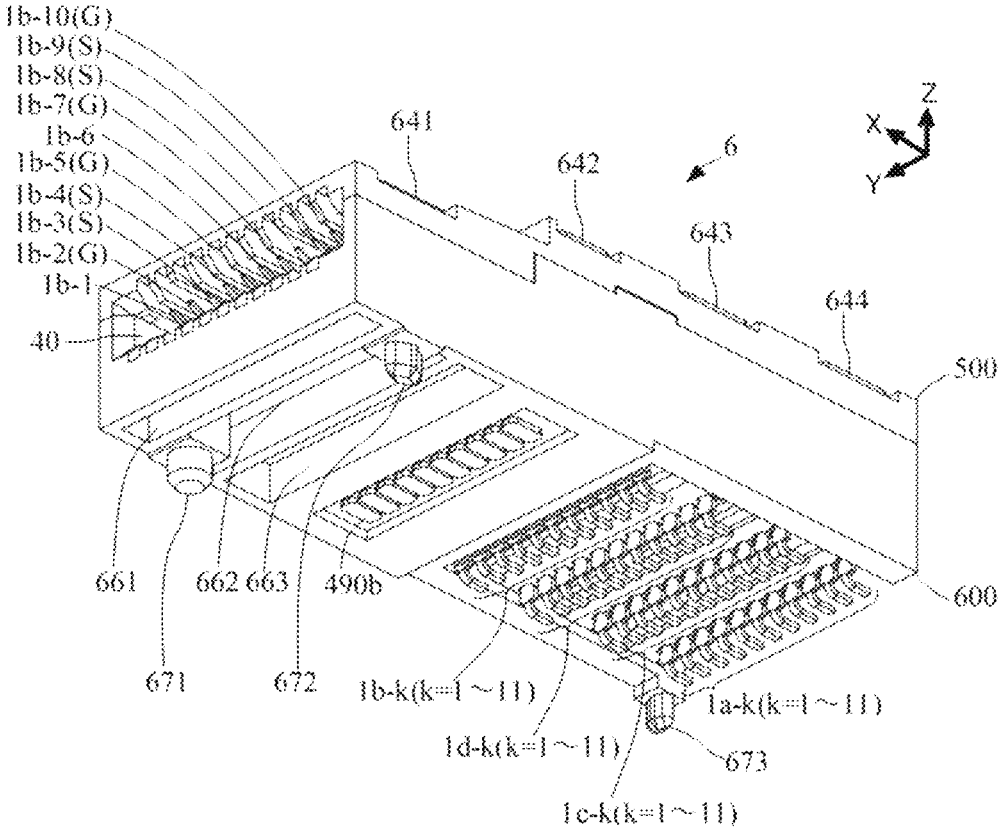
FIG. 2 is a perspective view of the high-speed transmission connector 6 of FIG. 1 as viewed from another angle.
Figure 4A:
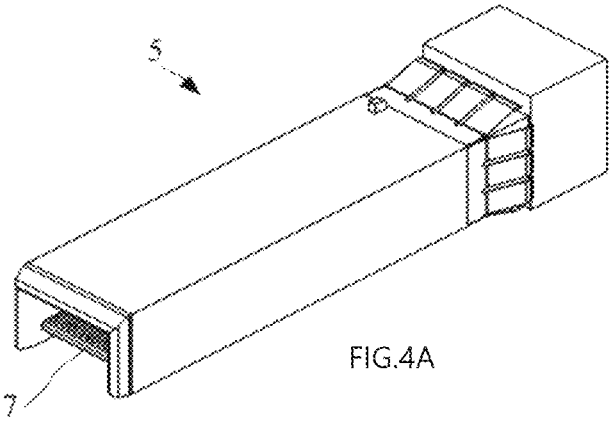
FIG. 4A is a perspective view of an optical transceiver 5 fitted to the high-speed transmission connector 6 of FIGS. 1 and 2.
Figure 4B:
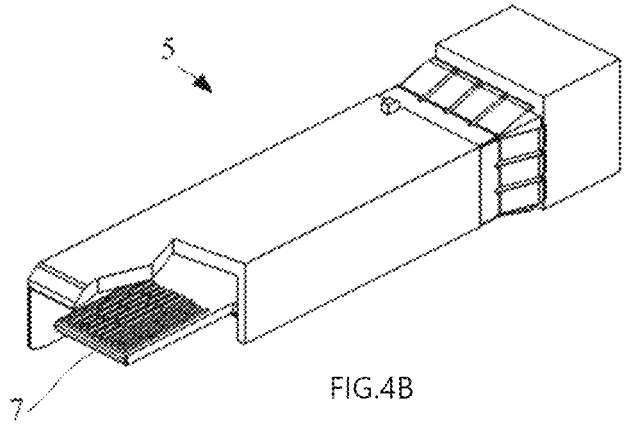
FIG. 4B is a view showing a header 7 of FIG. 4A is exposed.
Figure 4C:
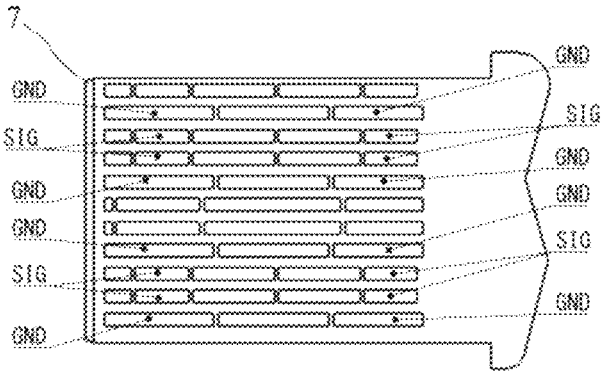
FIG. 4C is an enlarged view of the header 7 of FIG. 4B.

As shown in FIGS. 4A and 4B, the optical transceiver 5 has a stick shape. The header 7 projects from a front end of the optical transceiver 5. An upper side and left and right sides of the header 7 are covered with a housing. As shown in FIG. 4C, first to 11th pad rows are formed on an upper surface of the header 7. For each of the first pad row on the left end, the 4th pad row on the 4th from the left end, the 7th pad row on the 7th from the left end, and the 10th pad row on the 10th from the left end among the first to eleventh pad rows, provided are two ground pads GNDs spaced on the front and rear sides with one pad sandwiched therebetween. For each of the 3rd pad row on the 3rd from the left end, the 4th pad row on the 4th from the left end, the 9th pad row on the 9th from the left end, and the 10th pad row on the 10th from the left end, provided are two signal pads SIGs spaced on the front side and the rear side with two pads sandwiched therebetween.

First to 11th pad rows are also formed on a lower surface of the header 7. For each of the first pad row on the left end, the 4th pad row on the 4th from the left end, the 7th pad row on the 7th from the left end, and the 10th pad row on the 10th from the left end among the first to 11th pad rows, provided are two ground pads GNDs spaced on the front and rear sides with one pad sandwiched therebetween. For each of the 3rd pad row on the 3rd from the left end, the 4th pad row on the 4th from the left end, the 9th pad row on the 9th from the left end, and the 10th pad row on the 10th from the left end, provided are two signal pads SIGs spaced on the front side and the rear side with two pads sandwiched therebetween.

As shown in FIGS. 1, 2, and 3A to 3D, the high-speed transmission connector 6 includes an upper housing 500, a lower housing 600, an inner housing 400, a contact 1*a-k* (k=1 to 11) which is a first contact, a contact 1*b-k* (k=1 to 11) which is a second contact, a contact 1*c-k* (k=1 to 11) which is a third contact, a contact 1*d-k* (k=1 to 11) which is a fourth contact, a conductive member 510 which is a first conductive member, a conductive member 520 which is a second conductive member, a conductive member 610 which is a third conductive member, a conductive member 620 which is a fourth conductive member, a shielding plate 710 which is a first shielding plate, a shielding plate 720 which is a second shielding plate, an alignment plate 810 which is a first alignment plate, and an alignment plate 920 which is a second alignment plate.

Figure 5:
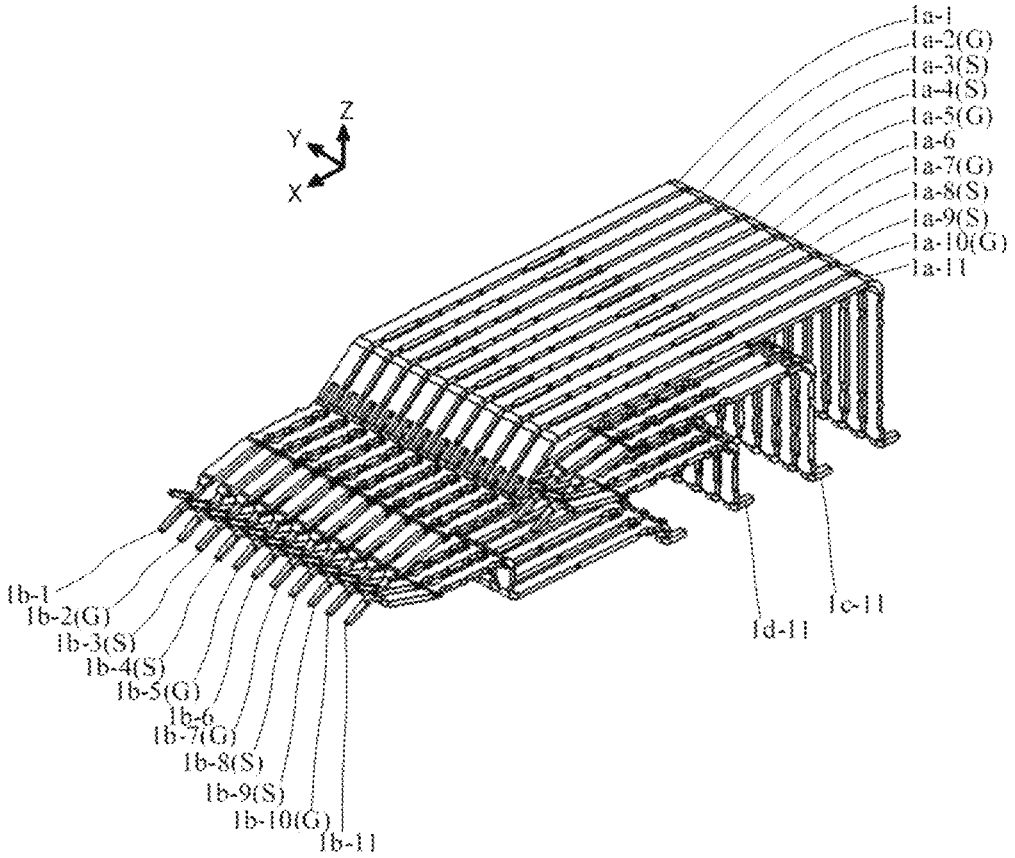
FIG. 5 is a perspective view of contacts 1*a*-*k* (k=1 to 11), 1*b*-*k* (k=1 to 11), 1*c*-*k* (k=1 to 11), and 1*d*-*k* (k=1 to 11) of FIGS. 1 and 2.
Figure 6:
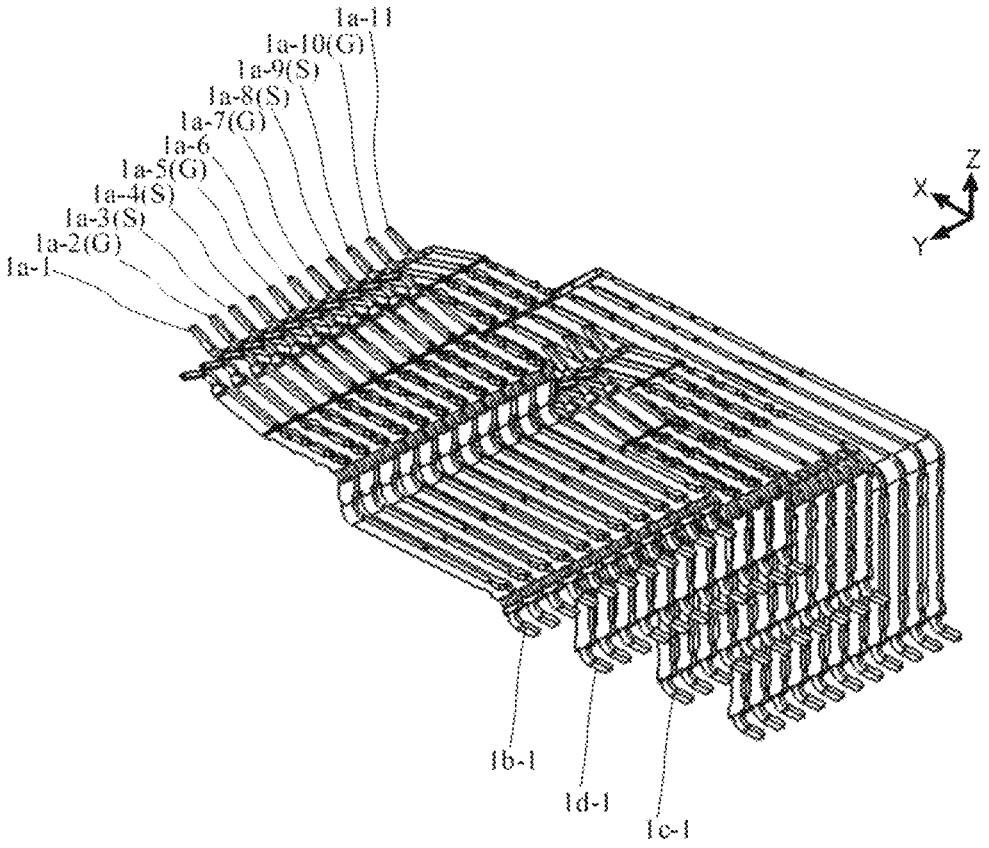
FIG. 6 is a perspective view of contacts 1*a*-*k* (k=1 to 11), 1*b*-*k* (k=1 to 11), 1*c*-*k* (k=1 to 11), and 1*d*-*k* (k=1 to 11) of FIGS. 1 and 2 as viewed from another angle.
Figure 7:
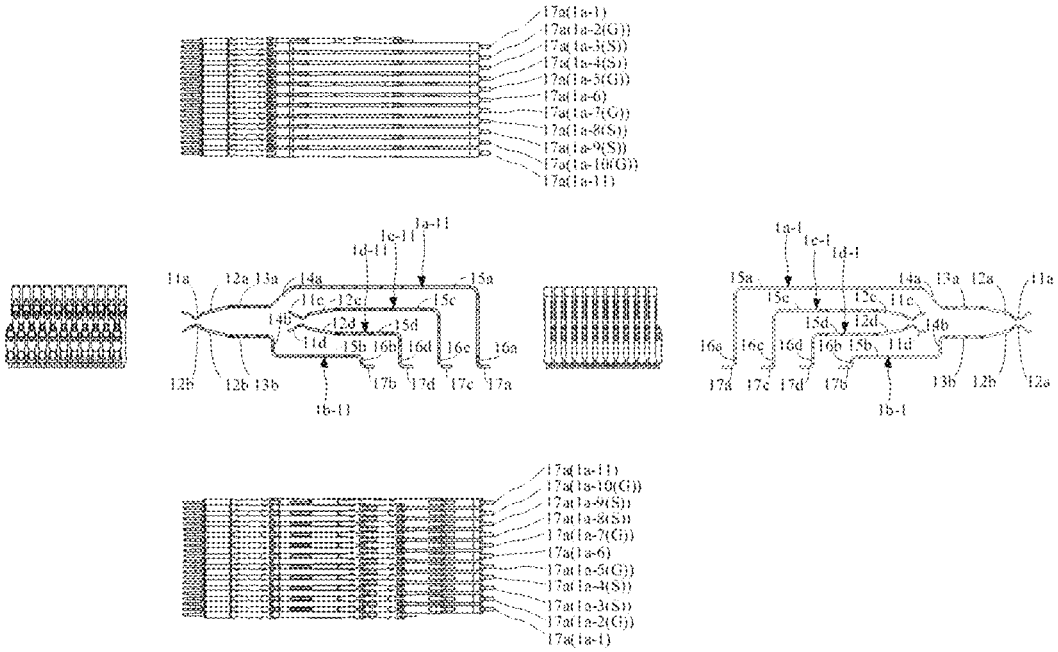
FIG. 7 is a six-surface view of contacts 1*a*-*k* (k=1 to 11), 1*b*-*k* (k=1 to 11), 1*c*-*k* (k=1 to 11), and 1*d*-*k* (k=1 to 11) of FIGS. 5 and 6.

The configuration of each of these components will be described below in detail. As shown in FIGS. 5, 6 and 7, contacts 1*a-k* (k=1 to 11), 1*b-k* (k=1 to 11), 1*c-k* (k=1 to 11), and 1*d-k* (k=1 to 11) are obtained by bending rod-shaped metal pieces at a plurality of positions. The contacts 1*a-k* (k=1 to 11), 1*b-k* (k=1 to 11), 1*c-k* (k=1 to 11), and 1*d-k* (k=1 to 11) are arranged laterally.

The contacts 1*a-k* (k=1 to 11), 1*b-k* (k=1 to 11), 1*c-k* (k=1 to 11), and 1*d-k* (k=1 to 11) each extend longitudinally. The longitudinal dimensions of the contacts 1*a-k*, 1*b-k*, 1*c-k*, and 1*d-k* decrease in the order of the contact 1*a-k*>contact 1*b-k*>contact 1*c-k*>contact 1*d-k*.

The contact 1*a-k* includes a tip side contact portion 11*a* bent in a L shape, a straight portion 12*a* extending diagonally upward and rearward from a rear end of the tip side contact portion 11*a*, a straight portion 13*a* extending rearward from a rear end of the straight portion 12*a*, a straight portion 14*a* extending diagonally upward and rearward from a rear end of the straight portion 13*a*, a straight portion 15*a* extending rearward from a rear end of the straight portion 14*a*, a straight portion 16*a* extending downward from a rear end of the straight portion 15*a*, and a substrate side contact portion 17*a* extending rearward from a lower end of the straight portion 16*a*.

The contact 1*b-k* includes a tip side contact portion 11*b* bent in a L shape, a straight portion 12*b* extending diagonally downward and rearward from a rear end of the tip side contact portion 11*b*, a straight portion 13*b* extending rearward from a rear end of the straight portion 12*b*, a straight portion 14*b* extending downward from a rear end of the straight portion 13*b*, a straight portion 15*b* extending rearward from a rear end of the straight portion 14*b*, a straight portion 16*b* extending downward from a rear end of the straight portion 15*b*, and a substrate side contact portion 17*b* extending rearward from a lower end of the straight portion 16*b*.

The contact 1*c-k* includes a tip side contact portion 11*c* bent in a L shape, a straight portion 12*c* extending diagonally upward and rearward from a rear end of the tip side contact portion 11*c*, a straight portion 15*c* extending rearward from a rear end of the straight portion 12*c*, a straight portion 16*c* extending downward from a rear end of the straight portion 15*c*, and a substrate side contact portion 17*c* extending rearward from a lower end of the straight portion 16*c*.

The contact 1*d-k* includes a tip side contact portion 11*d* bent in a L shape, a straight portion 12*d* extending diagonally downward and rearward from a rear end of the tip side contact portion 11*d*, a straight portion 15*d* extending rearward from a rear end of the straight portion 12*d*, a straight portion 16*d* extending downward from a rear end of the straight portion 15*d*, and a substrate side contact portion 17*d* extending rearward from a lower end of the straight portion 16*d*.

Here, among contacts 1*a-k* (k=1 to 11), 1*b-k* (k=1 to 11), 1*c-k* (k=1 to 11), and 1*d-k* (k=1 to 11), the leftmost contacts 1*a*-1, 1*b*-1, 1*c*-1, and 1*d*-1, the 5th contacts 1*a*-5, 1*b*-5, 1*c*-5, and 1*d*-5 from left, the 7th contacts 1*a*-7, 1*b*-7, 1*c*-7, and 1*d*-7 from left, the 10th contacts 1*a*-10, 1*b*-10, 1*c*-10, and 1*d*-10 from left are to be in contact with the ground pads GNDs of the header 7.

Also, the third contacts 1*a*-3, 1*b*-3, 1*c*-3, and 1*d*-3 from left, the 4th contacts 1*a*-4, 1*b*-4, 1*c*-4, and 1*d*-4 from left, the 8th contacts 1*a*-8, 1*b*-8, 1*c*-8, and 1*d*-8 from left, and the 9th contacts 1*a*-9, 1*b*-9, 1*c*-9, and 1*d*-9 from left are to be contact with the signal pads SIGs of the header 7.

Hereinafter, appropriately, the contacts 1*a-k*, 1*b-k*, 1*c-k*, and 1*d-k* to be in contact with the ground pads GNDs are labeled with letter (G), and the contacts 1*a-k*, 1*b-k*, 1*c-k*, and 1*d-k* to be in contact with the signal pads SIGs are labeled with letter (S), to distinguish them.

Figure 8:
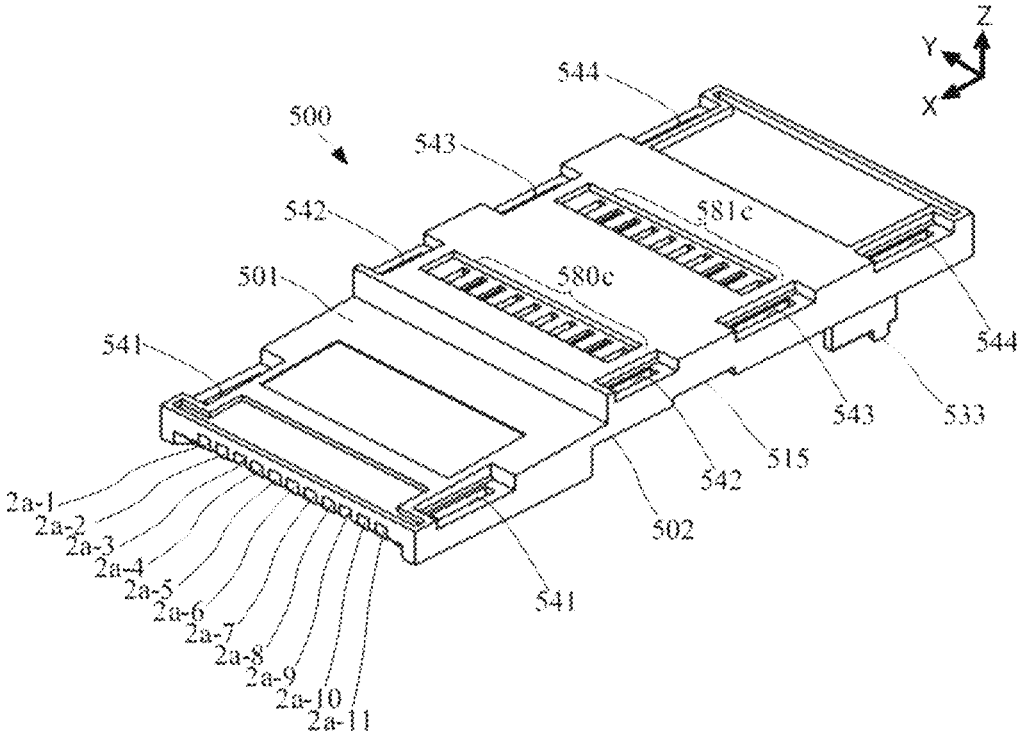
FIG. 8 is a perspective view of an upper housing 500 of FIGS. 1 and 2.
Figure 9:
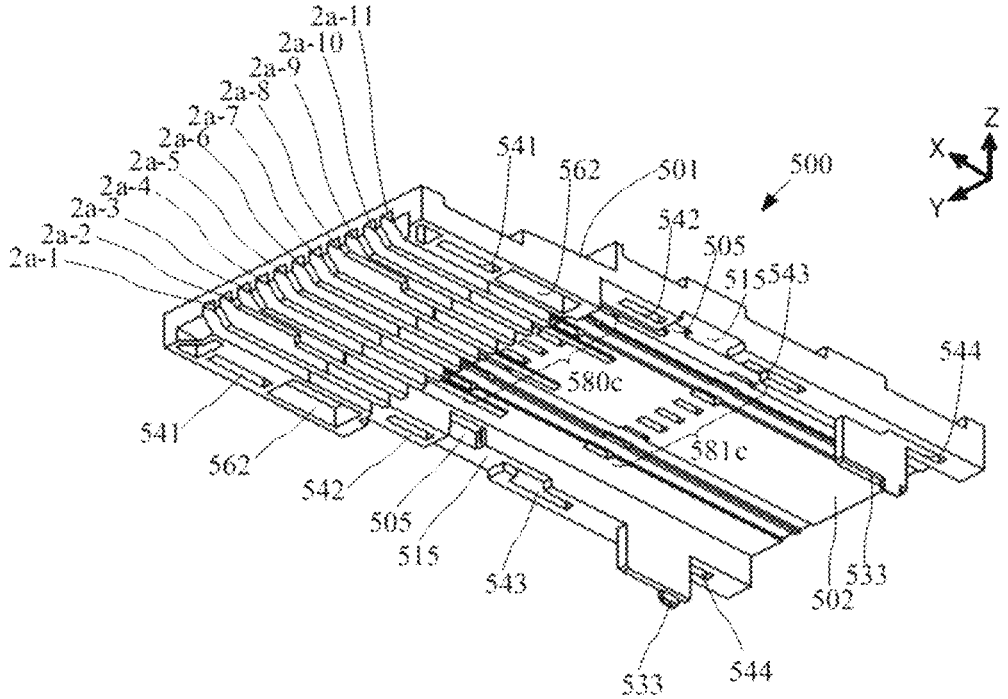
FIG. 9 is a perspective view of the upper housing 500 of FIGS. 1 and 2 as viewed from another angle.
Figure 10:
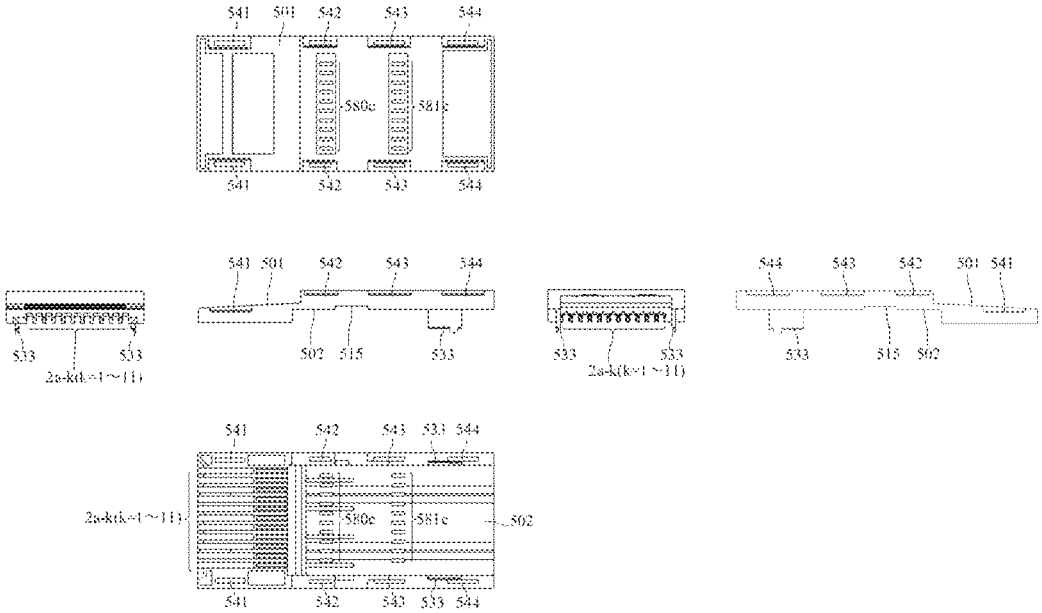
FIG. 10 is a six-surface view of the upper housing 500 of FIGS. 8 and 9.

As shown in FIGS. 8, 9, and 10, the upper housing 500 has a thin plate shape. A part of the upper surface of the upper housing 500 on the front side is gouged downward to form a stepped portion 501. A part of the lower surface of the upper housing 500 on the rear side is gouged upward to form a stepped portion 502. A rectangular hole 541 is formed slightly inside the left and right ends of the stepped portion 501 of the upper housing 500. The rectangular hole 541 penetrates the upper housing 500 vertically.

A cavity 562 is provided on the rear side of the rectangular hole 541 on the back surface of the upper housing 500. A row of grooves 2*a-k* (k=1 to 11) which are first grooves separated by a partition wall are formed between the rectangular hole 541 and the cavity 562 on the left side and the rectangular hole 541 and the cavity 562 on the right side on the back surface of the upper housing 500. The grooves 2*a-k* (k=1 to 11) are arranged laterally. Each of the grooves 2*a-k* (k=1 to 11) extends longitudinally.

Rectangular holes 542, rectangular holes 543, and rectangular holes 544 are formed slightly inside the left and right ends of the stepped portion 502 of the upper housing 500. The rectangular hole 542, the rectangular hole 543, and the rectangular hole 544 are spaced from each other in the longitudinal direction. The rectangular hole 542, the rectangular hole 543, and the rectangular hole 544 penetrate the upper housing 500 vertically.

Recesses 515 that are upwardly recessed are formed on the rear side of the rectangular holes 542 on the left and right sides in the stepped portion 502. Recesses 505 that are further upwardly recessed are formed on the front side of the recesses 515. 10 rectangular holes 580*c* arranged laterally are formed between the left and right rectangular holes 542 in the stepped portion 502. 10 rectangular holes 581*c* arranged laterally are formed between the left and right rectangular holes 543. The rectangular holes 580*c* and the rectangular holes 581*c* penetrate the upper housing 500 vertically. A support plate 533 is provided on the inner side of the rectangular holes 544 on the left and right sides in the stepped portion 502. The support plate 533 projects downward.

Figure 11:
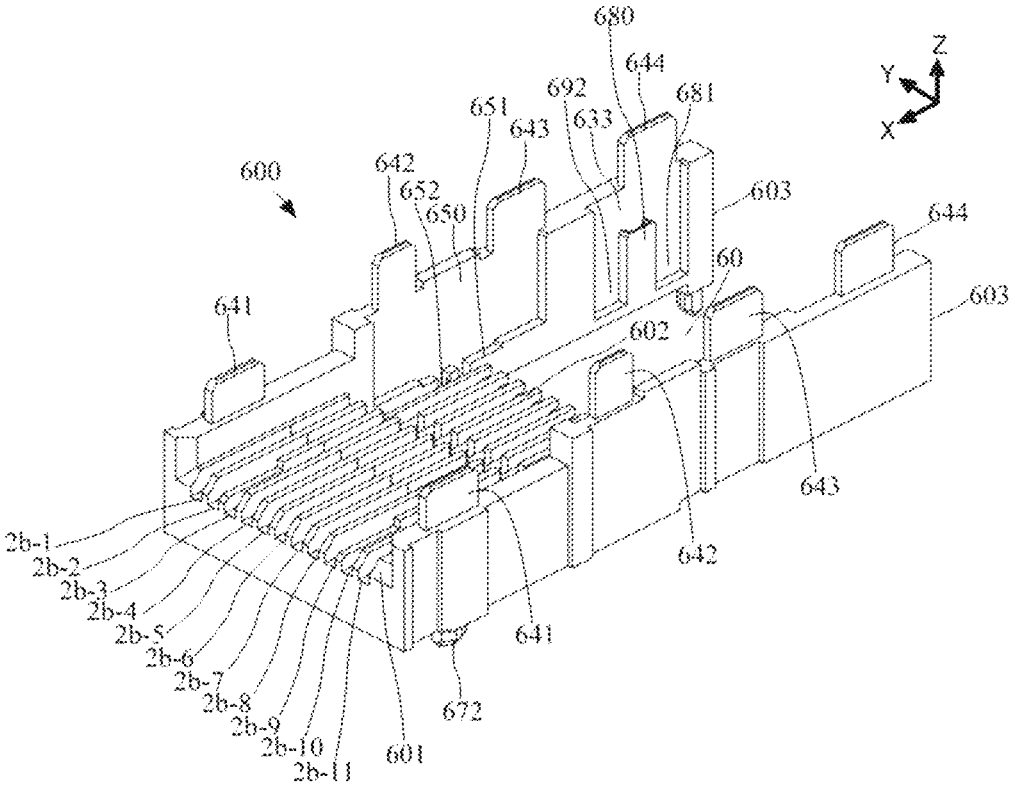
FIG. 11 is a perspective view of a lower housing 600 of FIGS. 1 and 2.
Figure 12:
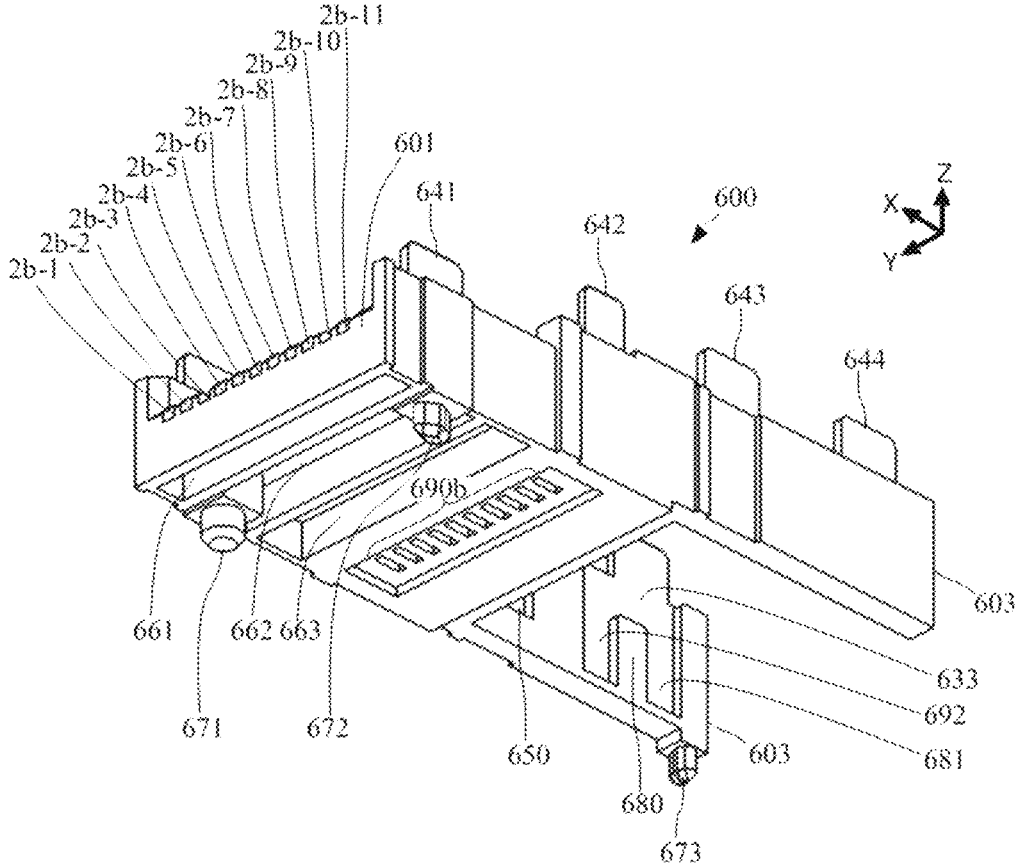
FIG. 12 is a perspective view of the lower housing 600 of FIGS. 1 and 2 as viewed from another angle.
Figure 13:
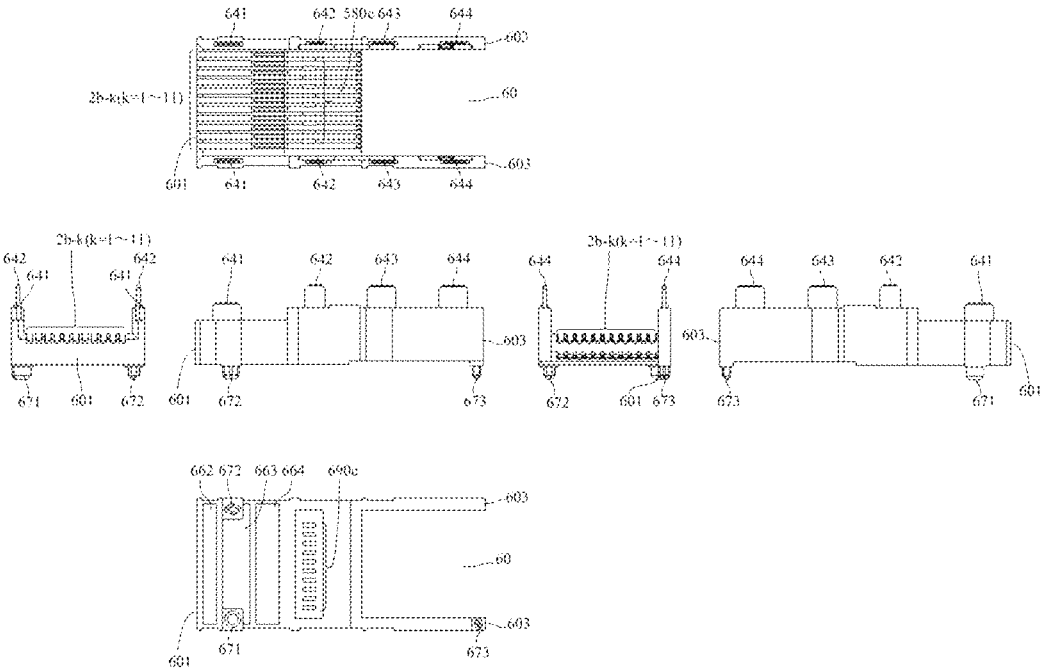
FIG. 13 is a six-surface view of the lower housing 600 of FIGS. 11 and 12.

As shown in FIGS. 11, 12, and 13, the lower housing 600 includes a pair of side plate portions 603 on the left and right sides and a bottom plate portion 601. The side plate portions 603 have substantially the same anteroposterior width as that of the upper housing 500. The bottom plate portion 601 has an anteroposterior width approximately half the width of the upper housing 500. Parts of the side plate portions 603 on the front side thereof are formed integrally with the bottom plate portion 601. A part of the bottom plate portion 601 on the rear side is gouged downward to form a stepped portion 602.

On the rear side of the bottom plate portion 601 there is formed a gap 60 between one lower end portion of the side plate portion 603 and the other lower end portion of the side plate portion 603. A support plate 641, a support plate 642, a support plate 643, and a support plate 644 are provided on the upper surface of the side plate portion 603. The support plate 641, the support plate 642, the support plate 643, and the support plate 644 project upward.

On the lower side of the support plate 642 and of the support plate 643, on the inner surface of the side plate portion 603, a recess 650 is formed so as to be slightly recessed outward from an inner surface of the side plate portion 603. The concave surface of the recess 650 is flush with inner surfaces of the support plate 642 and the support plate 643. A recess 651 that is recessed downward is provided at the bottom of the recess 650. A recess 652 that is recessed further downward is provided at the bottom of the recess 651.

On the lower side of the support plate 644 on the inner surface of the side plate portion 603 a recess 633 is formed so as to be slightly recessed outward from the inner surface of the side plate portion 603. A part of the recess 633 on the lower side is divided into a dent 681 and a dent 692 by a partition 680 extending upward from the center of the bottom surface of the recess 633 in the longitudinal direction.

A row of grooves 2*b-k* (k=1 to 11), which are second grooves separated by a partition wall, are formed on the upper surface of the bottom plate portion 601. The grooves 2*b-k* (k=1 to 11) are arranged laterally. The grooves 2*b-k* (k=1 to 11) extend longitudinally. 10 rectangular holes 690*b* arranged laterally are formed at a bottom of a cut of the partition wall separating the grooves 2*b-k* (k=1 to 11) in the stepped portion 602. The rectangular holes 690*b* penetrate the stepped portion 602 vertically.

Cavities 661, 662, and 663 are provided on the lower surface of the bottom plate portion 601. Positioning bosses 671 and 672 are provided on both the left and right sides of the cavity 662 on the lower surface of the bottom plate portion 601. A positioning boss 673 is also provided at the rear end of the lower surface of the plate portion 603 on the left side.

Figure 14:
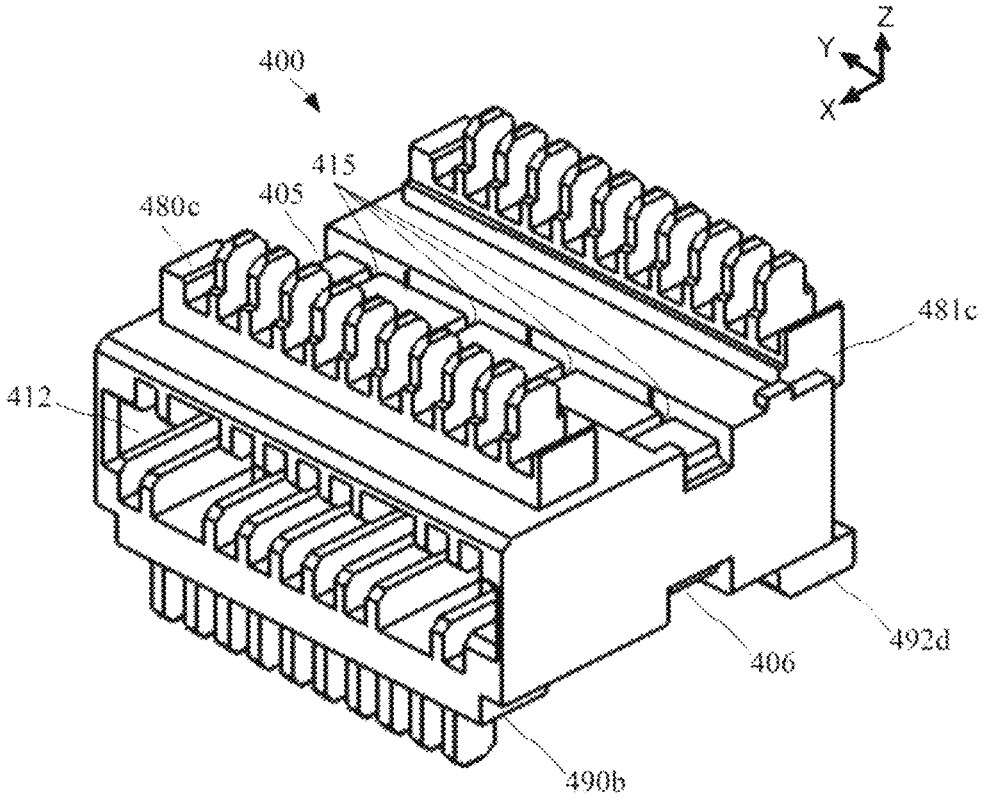
FIG. 14 is a perspective view of an inner housing 400 of FIGS. 1 and 2.
Figure 15:
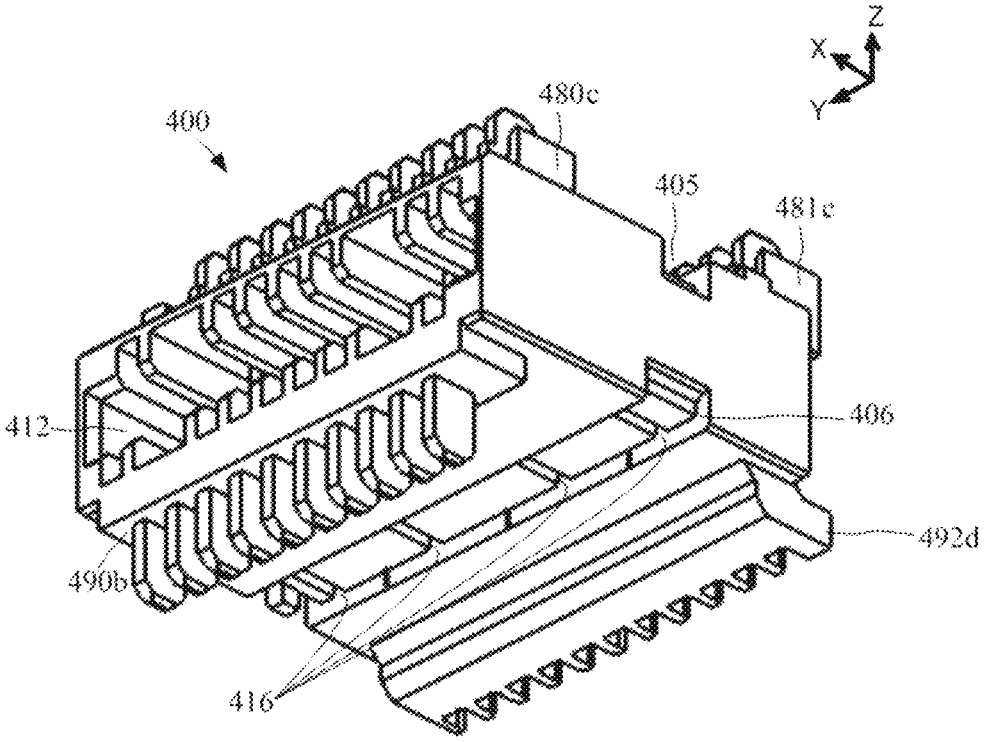
FIG. 15 is a perspective view of the inner housing 400 of FIGS. 1 and 2 as viewed from another angle.
Figure 16:
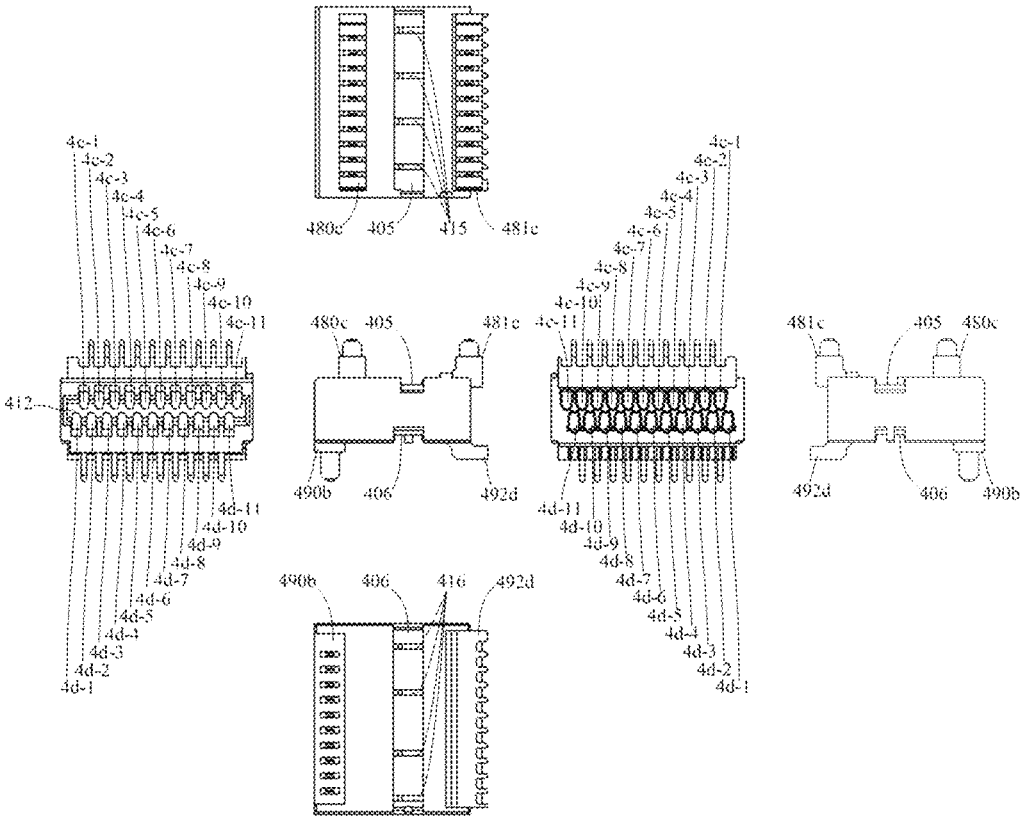
FIG. 16 is a six-surface view of the inner housing 400 of FIGS. 14 and 15.

As shown in FIGS. 14, 15, and 16, the inner housing 400 has a substantially rectangular parallelepiped shape. A rectangular opening 412 is formed on the front surface of the inner housing 400. A row of through holes 4*c*-*k* (k=1 to 11) which are first holes, and a row of through holes 4*d*-*k* (k=1 to 11) which are second holes are provided at the deep part of the opening 412. The through holes 4*c*-*k* (k=1 to 11) and 4*b*-*k* (k=1 to 11) are respectively divided into upper and lower parts and arranged laterally. Each of the through holes 4*c*-*k* (k=1 to 11) and the through holes 4*d*-*k* (k=1 to 11) penetrates between a surface of the opening 412 at the deep part thereof and the rear surface on the back side thereof and extends longitudinally.

Grooves separated by a partition wall are formed on each of the upper and lower surfaces of the opening 412. The upper and lower grooves are arranged laterally. The upper and lower grooves each extend longitudinally and are connected to the through holes 4*c*-*k* and 4*d*-*k*, respectively.

Front and rear central portions of the upper surface and the lower surface of the inner housing 400 are recessed inward as recesses 405 and 406. Slits 415 are formed in the recess 405. The slits 415 communicate with the through holes 4*c*-2, 4*c*-5, 4*c*-7, and 4*c*-10. Slits 416 are formed in the recess 406. The slits 416 communicate with the through holes 4*b*-2, 4*b*-5, 4*b*-7, and 4*b*-10.

A protrusion 480*c* and a protrusion 481*c* protruding upward are respectively provided on the front side and the rear side of the recess 405 on the upper surface of the inner housing 400. The rear end of the protrusion 481*c* projects further rearward than the rear surface of the inner housing 400. Grooves separated by a partition wall are formed on the upper surface of the protrusion 480*c* and the upper surface of the protrusion 481*c*.

A protrusion 490*b* and a protrusion 492*d* protruding downward are respectively provided on the front and rear sides of the recess 406 on the lower surface of the inner housing 400. The rear end of the protrusion 492*d* projects further rearward than the rear surface of the inner housing 400. Grooves separated by a partition wall are formed on the lower surface of the protrusion 490*b*. A groove recessed in a comb blade shape is formed on the rear surface of the protrusion 492*d*. The grooves of the protrusion 492*d* are arranged laterally. The grooves of the protrusion 492*d* each extend vertically.

Figure 17:
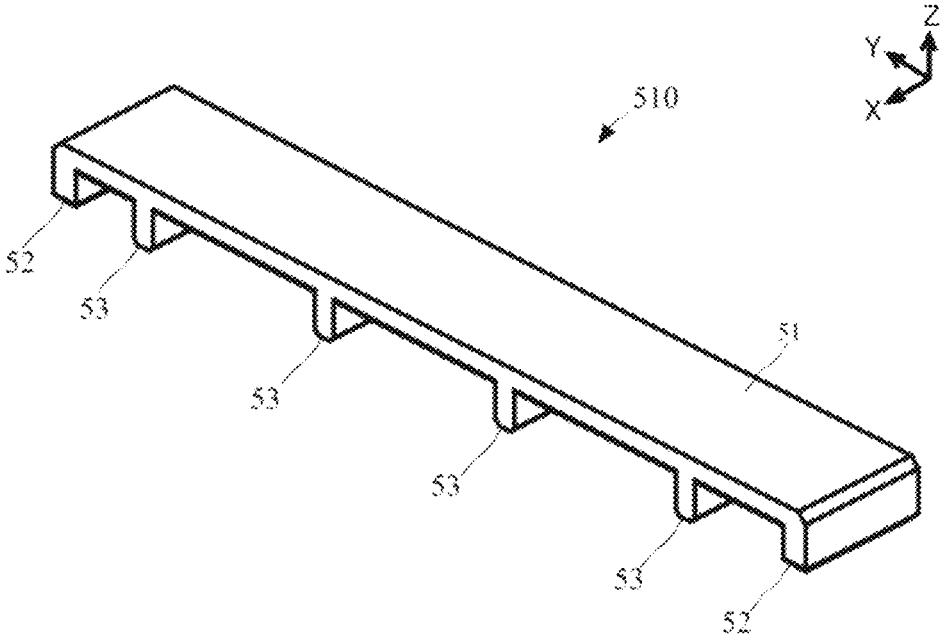
FIG. 17 is a perspective view of a conductive member 510 of FIGS. 1 and 2.
Figure 18:
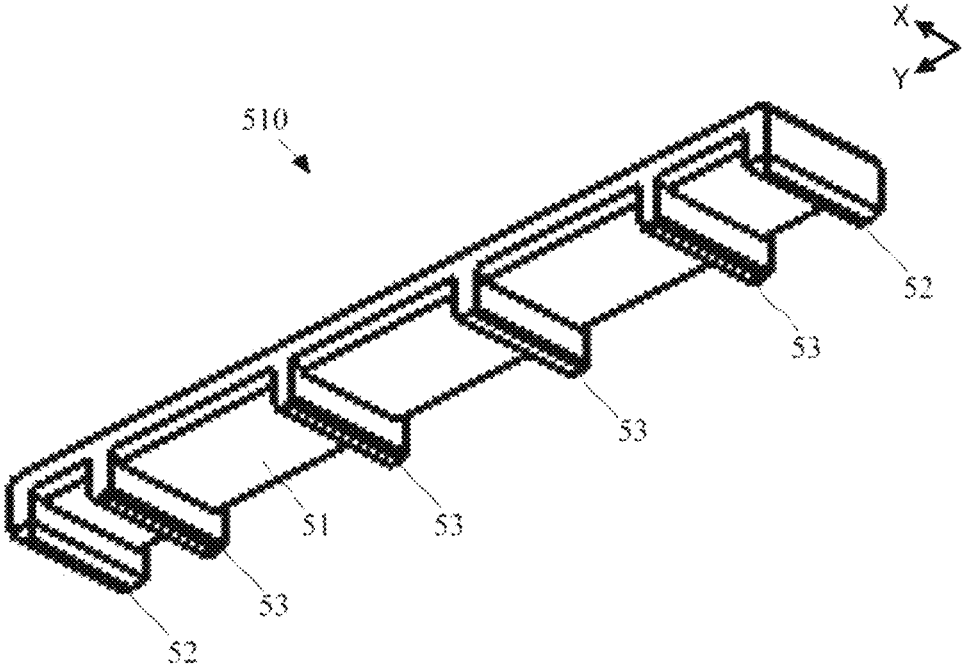
FIG. 18 is a perspective view of the conductive member 510 of FIGS. 1 and 2 as viewed from another angle.
Figure 19:
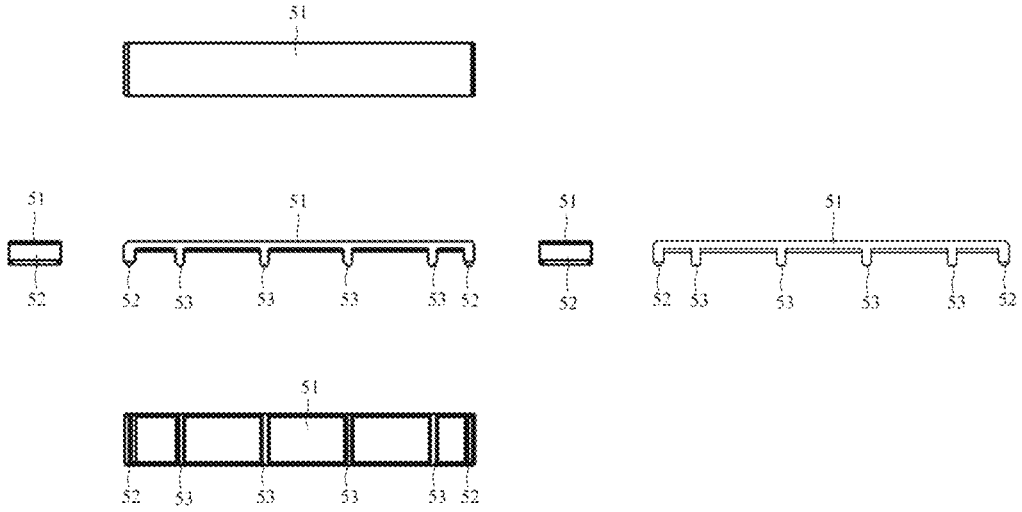
FIG. 19 is a six-surface view of the conductive member 510 of FIGS. 17 and 18.

As shown in FIGS. 17, 18, and 19, the conductive member 510 includes a horizontal plate portion 51 extending laterally in a straight manner, end portions 52 formed by bending the left and right ends of the horizontal plate portion 51 into an L shape, and projected portions 53 that rise up from four positions on the surface of the horizontal plate portion 51 on the side of which the end portions 51 are bent. The conductive member 520 has the same configuration as the conductive member 510.

Figure 20:
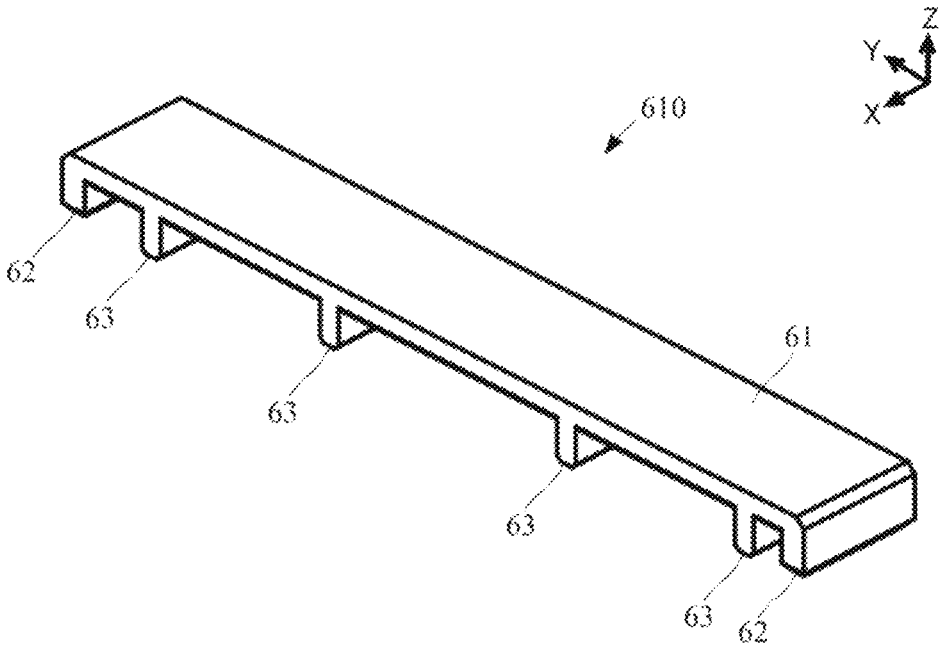
FIG. 20 is a perspective view of a conductive member 610 of FIGS. 1 and 2.
Figure 21:
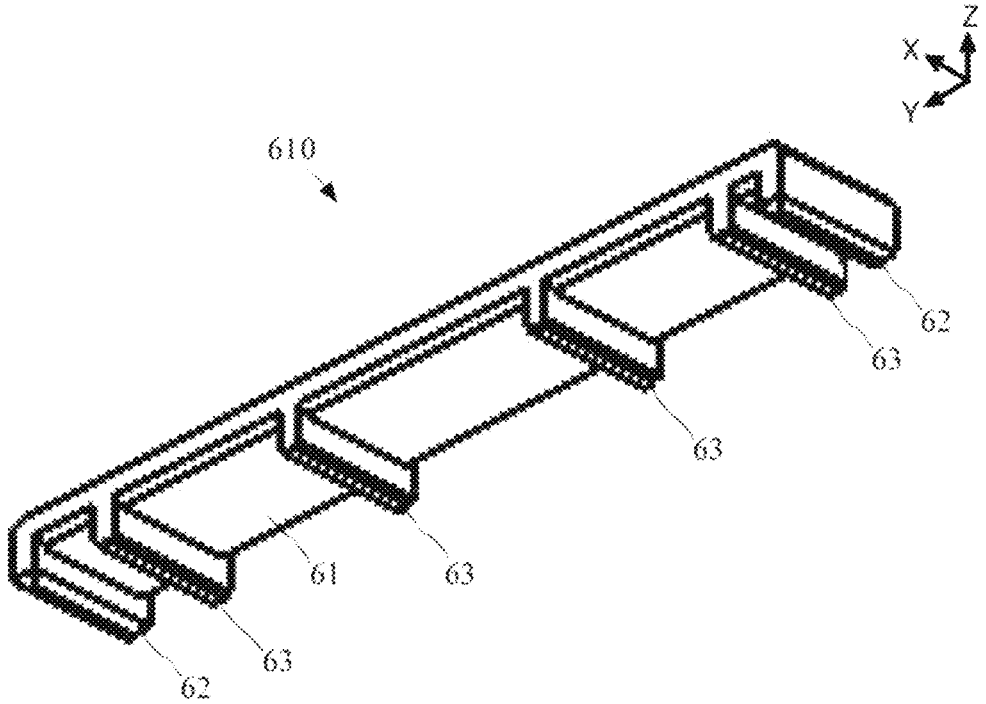
FIG. 21 is a perspective view of the conductive member 610 of FIGS. 1 and 2 as viewed from another angle.
Figure 22:
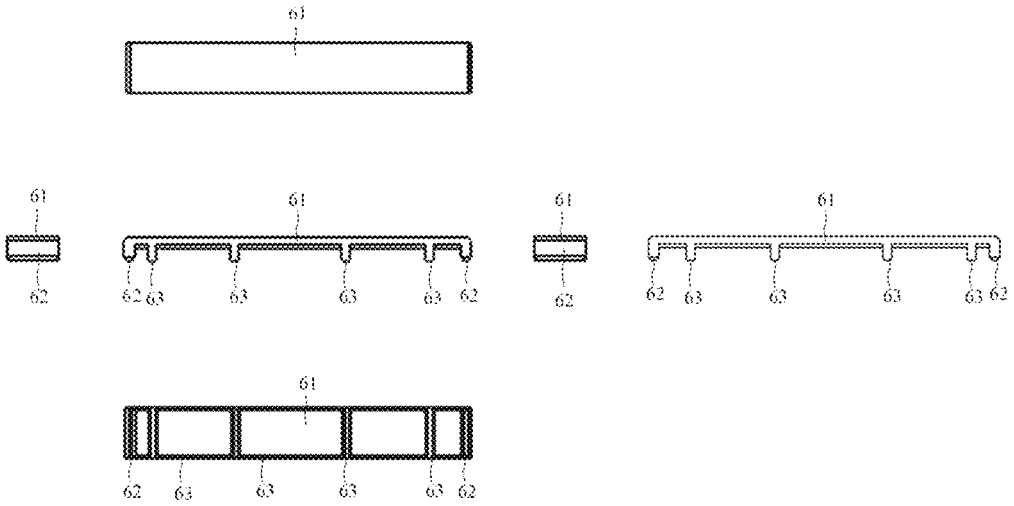
FIG. 22 is a six-surface view of the conductive member 610 of FIGS. 20 and 21.

As shown in FIGS. 20, 21, and 22, the conductive member 610 includes a horizontal plate portion 61 extending laterally in a straight manner, end portions 62 formed by bending the left and right ends of the horizontal plate portion 61 into an L shape, and projected portions 63 that rise up from four positions on the surface of the horizontal plate portion 61 on the side of which the end portions 62 are bent. The conductive member 620 has the same configuration as the conductive member 610.

Figure 23:
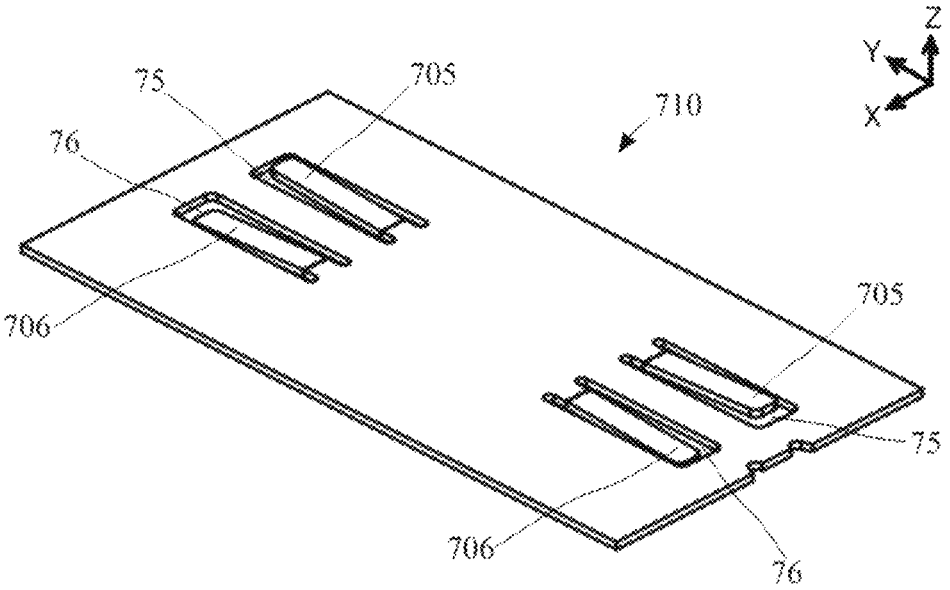
FIG. 23 is a perspective view of a shielding plate 710 of FIGS. 1 and 2.
Figure 24:
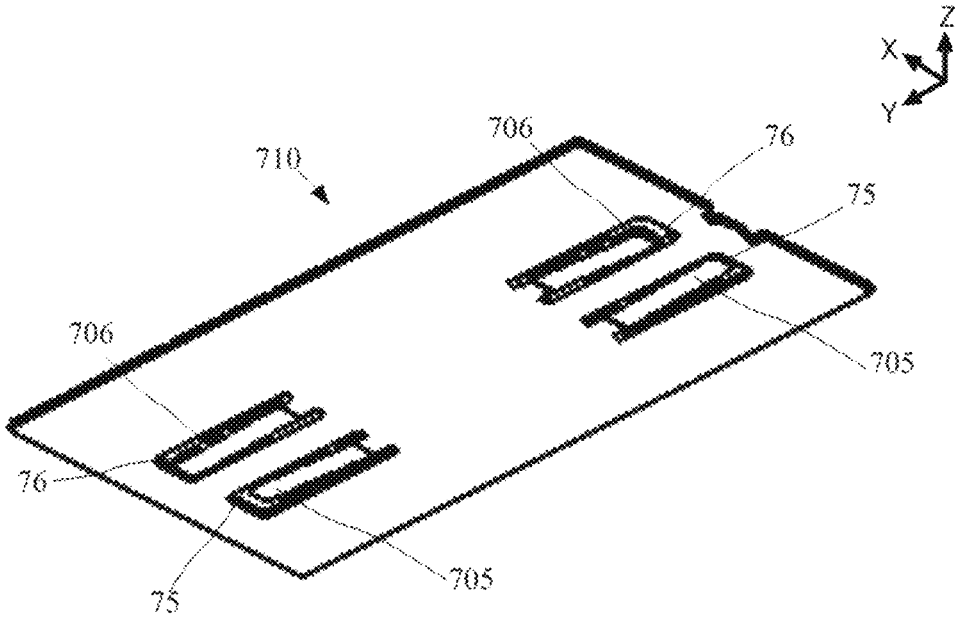
FIG. 24 is a perspective view of the shielding plate 710 of FIGS. 1 and 2 as viewed from another angle.
Figure 25:
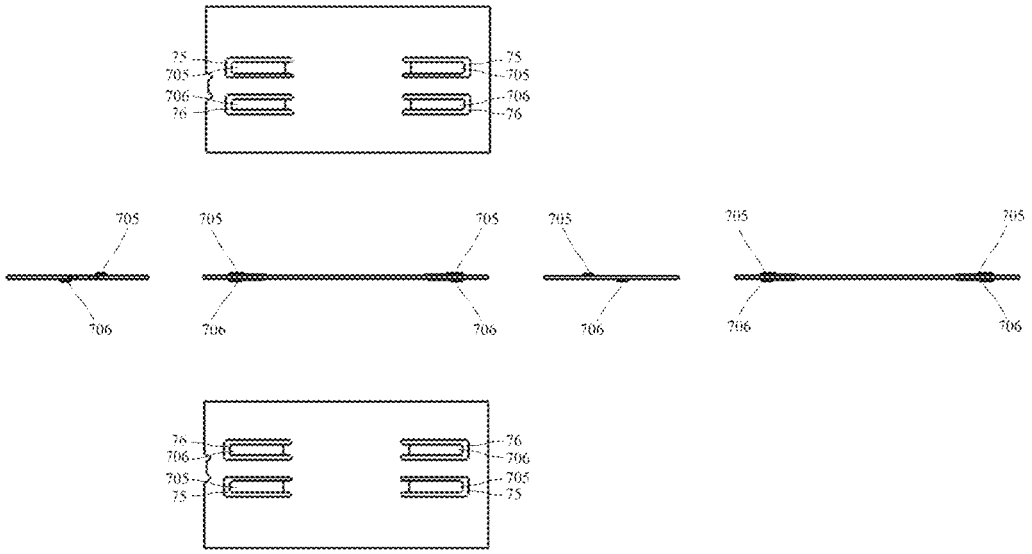
FIG. 25 is a six-surface view of the shielding plate 710 of FIGS. 23 and 24.

As shown in FIGS. 23, 24, and 25, the shielding plate 710 has a thin rectangular plate shape. The shielding plate 710 is formed with a notch 75 and a tilting plate portion 705 surrounded by the notch 75, as well as a notch 76 and a tilting plate portion 706 surrounded by the notch 76. The notch 75 and the tilting plate portion 705 as well as the notch 76 and the tilting plate portion 706 are positioned mirror-symmetrically with respect to a center line passing through a center of the shielding plate 710 in the lateral direction.

The tilting plate portion 705 extends diagonally upward in a slightly inclined manner from a base on a side of a center of the shielding plate 710 in the lateral direction. A tip of the tilting plate portion 705 protrudes above the shielding plate 710. The tilting plate portion 706 extends diagonally downward in a slightly inclined manner from the base on a side of a center of the shielding plate 710 in the lateral direction. A tip of the tilting plate portion 706 protrudes below the shielding plate 710. The shielding plate 720 has the same configuration as the shielding plate 710.

Figure 26:
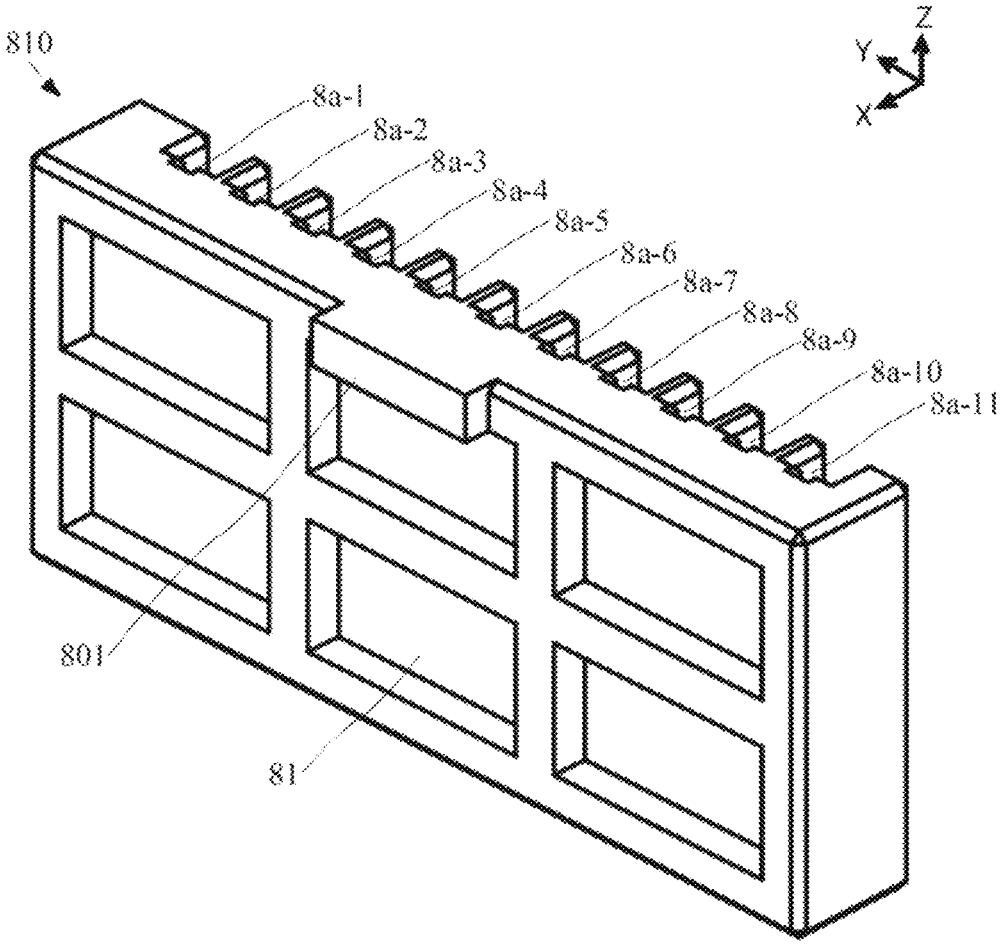
FIG. 26 is a perspective view of an alignment plate 810 of FIGS. 1 and 2.
Figure 27:
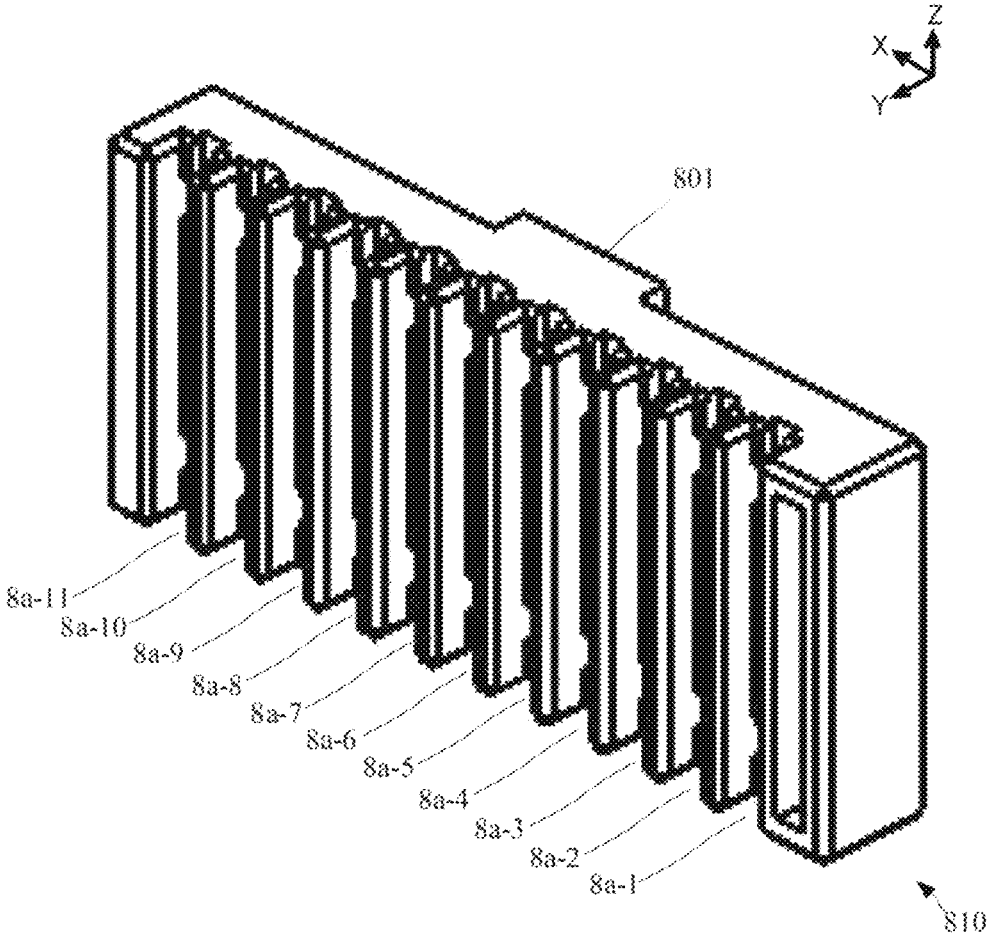
FIG. 27 is a perspective view of the alignment plate 810 of FIGS. 1 and 2 as viewed from another angle.
Figure 28:
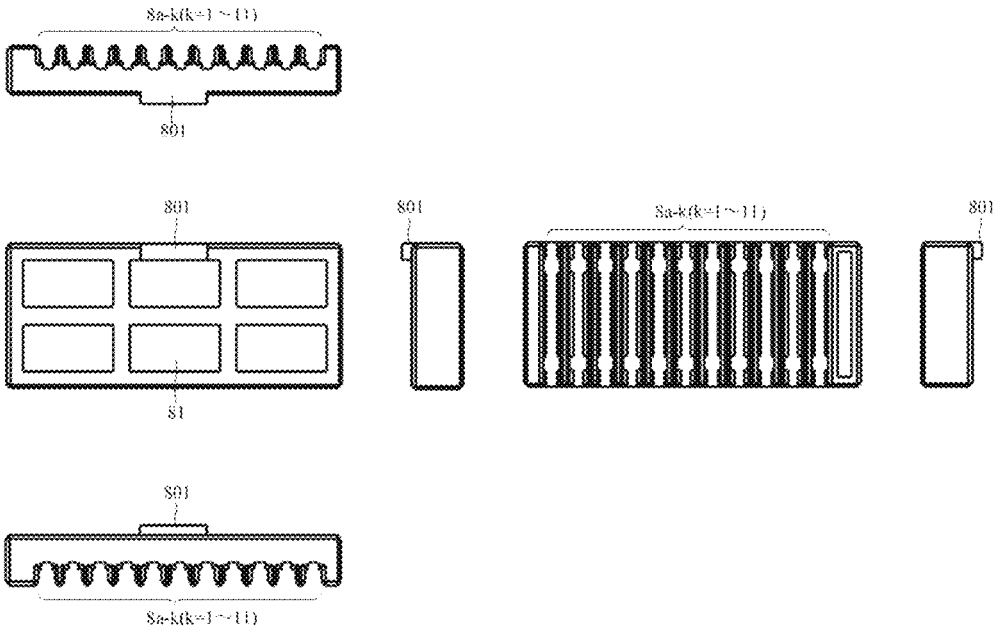
FIG. 28 is a six-surface view of the alignment plate 810 of FIGS. 26 and 27.

As shown in FIGS. 26, 27, and 28, the alignment plate 810 has a substantially rectangular parallelepiped shape. A protrusion 801 is provided at an upper end of a front surface of the alignment plate 810, and six cavities 81 are provided below the protrusion 801. Grooves 8*a*-*k* (k=1 to 11) recessed in a comb blade shape are provided on the rear surface of the alignment plate 810. The grooves 8*a*-*k* (k=1 to 11) are arranged laterally. Each of the grooves 8*a*-*k* (k=1 to 11) extends vertically.

Figure 29:
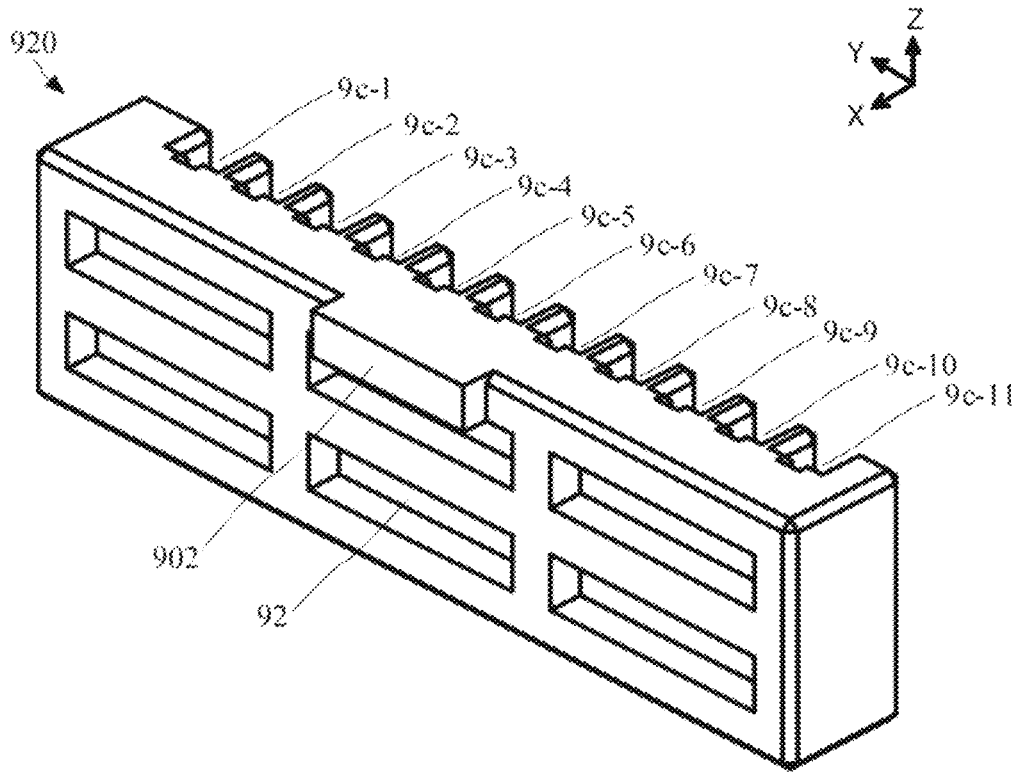
FIG. 29 is a perspective view of the alignment plate 920 of FIGS. 1 and 2.
Figure 30:
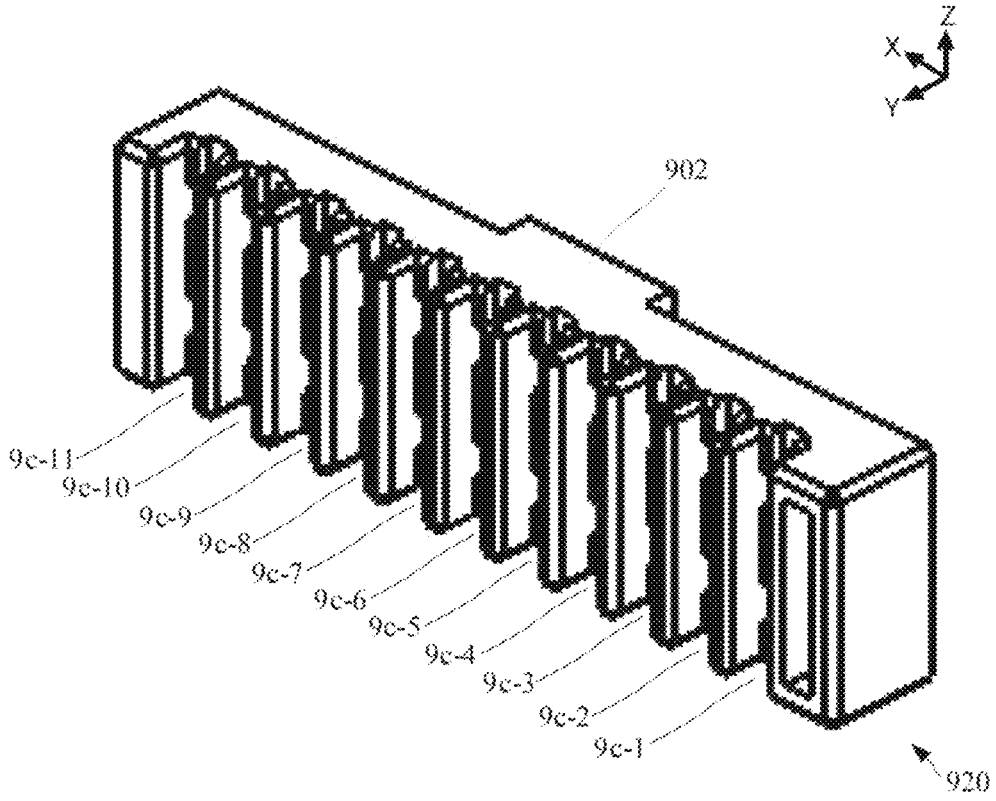
FIG. 30 is a perspective view of the alignment plate 920 of FIGS. 1 and 2 as viewed from another angle.
Figure 31:
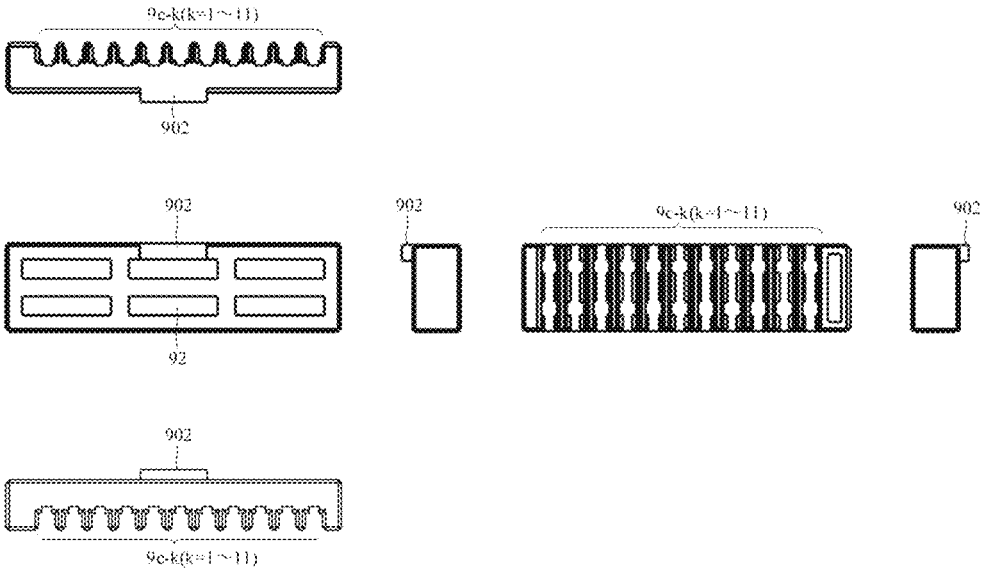
FIG. 31 is a six-surface view of the alignment plate 920 of FIGS. 29 and 30.

As shown in FIGS. 29, 30, and 31, the alignment plate 920 has a substantially rectangular parallelepiped shape. The vertical dimension of the alignment plate 920 is smaller than the vertical dimension of the alignment plate 810. A protrusion 902 is provided at an upper end of a front surface of the alignment plate 920, and six cavities 92 are provided below the protrusion 902. Grooves 9*c*-*k* (k=1 to 11) recessed in a comb blade shape are provided on the rear surface of the alignment plate 920. The grooves 9*c*-*k* (k=1 to 11) are arranged laterally. Each of the grooves 9*c*-*k* (k=1 to 11) extends vertically.

The details of the configurations of the components are described above. Among these components, the row of contacts 1*a*-*k* (k=1 to 11) are supported by the upper housing 500, the row of contacts 1*b*-*k* (k=1 to 11) are supported by the lower housing 600, and the row of contacts 1*c*-*k* (k=1 to 11) and the row of contacts 1*d*-*k* (k=1 to 11) are supported by the inner housing 400. The upper housing 500, the lower housing 600, and the inner housing 400 are assembled in such a manner that the upper housing 500 and the lower housing 600 face each other in a vertical direction with a gap therebetween, and that the inner housing 400 is accommodated in these two housing (the upper housing 500 and the lower housing 600).

Figure 32:
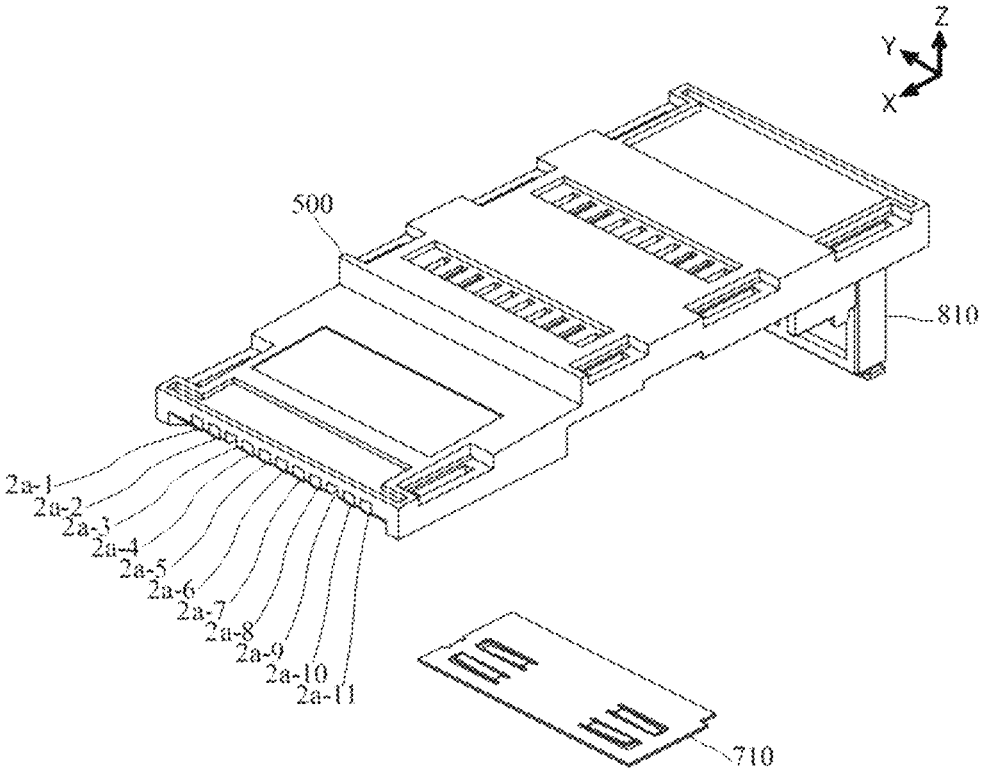
FIG. 32 is a view showing the positional relationship of the upper housing 500, the conductive member 510, the shielding plate 710, and the alignment plate 810 in the high-speed transmission connector 6 of FIGS. 1 and 2.
Figure 33:
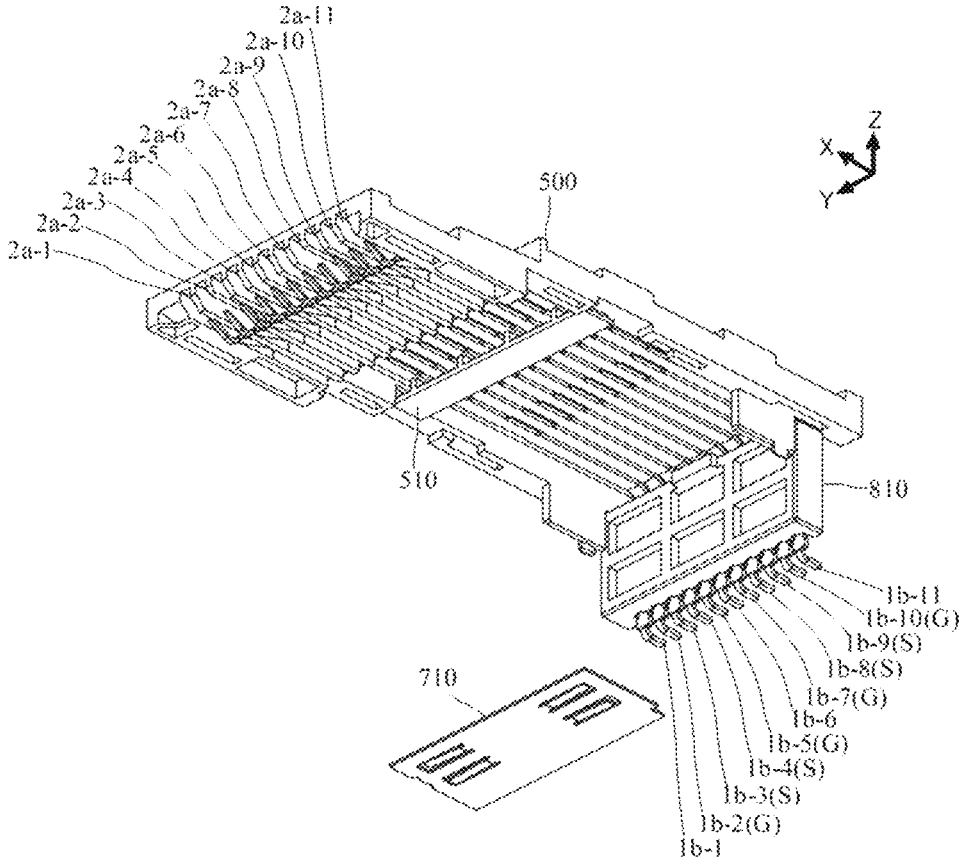
FIG. 33 is a view showing the positional relationship of the upper housing 500, the conductive member 510, the shielding plate 710, and the alignment plate 810 in the high-speed transmission connector 6 of FIGS. 1 and 2 as viewed from another angle.

More specifically, as shown in FIGS. 32 and 33, the straight portions 13*a* of the contacts 1*a*-*k* (k=1 to 11) are press-fitted into the grooves 2*a*-*k* (k=1 to 11) of the upper housing 500. The tip side contact portions 11*a* of the contacts 1*a*-*k* (k=1 to 11) protrude below the grooves 2*a*-*k* (k=1 to 11). The conductive member 510 is arranged below the contacts 1*a*-*k* (k=1 to 11). The left and right ends of the conductive member 510 are respectively fitted into the left and right recesses 505 of the upper housing 500 and supported by the left and right recesses 505. The tip of the protrusion 53 of the conductive member 510 comes into contact with the straight portions 15*a* of the contacts 1*a*-2 (G), 1*a*-5 (G), 1*a*-7 (G), and 1*a*-10 (G) from below.

Figure 34:
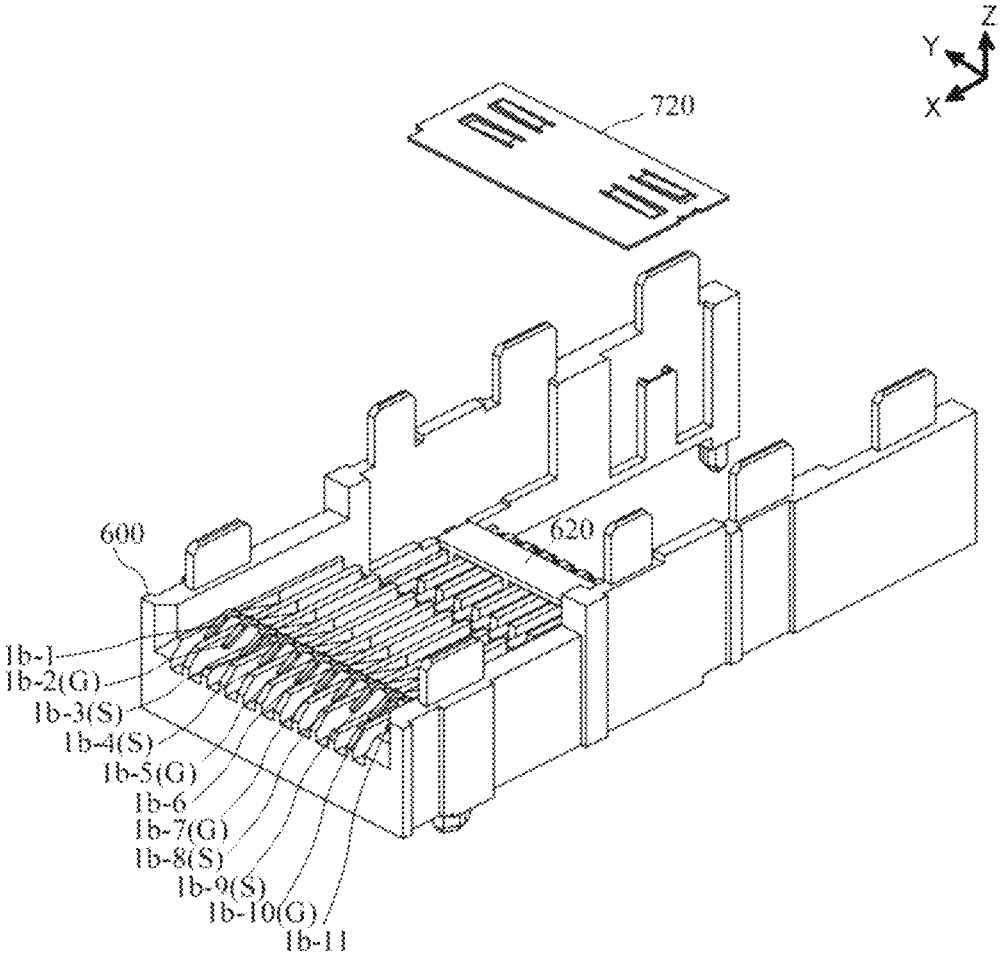
FIG. 34 is a view showing the positional relationship of the lower housing 600, the conductive member 620, and the shielding plate 720 in the high-speed transmission connector 6 of FIGS. 1 and 2.
Figure 35:
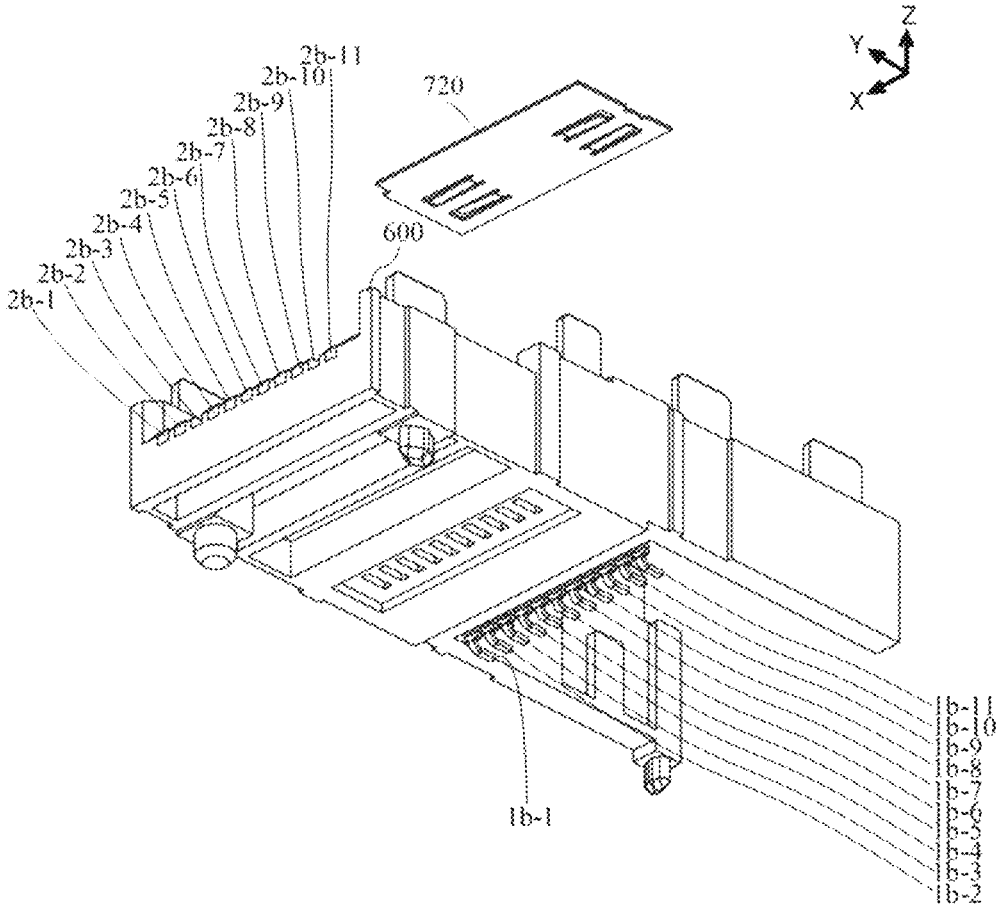
FIG. 35 is a view showing the positional relationship of the lower housing 600, the conductive member 620, and the shielding plate 720 in the high-speed transmission connector 6 of FIGS. 1 and 2 as viewed from another angle.

As shown in FIGS. 34 and 35, the straight portions 13*b* and 15*b* of the contacts 1*b*-*k* (k=1 to 11) are press-fitted into the grooves 2*b*-*k* (k=1 to 11) of the lower housing 600. The tip side contact portions 11*b* of the contacts 1*b*-*k* (k=1 to 11) protrude above the groove 2*b*-*k* (k=1 to 11). The conductive member 620 is arranged above the contacts 1*b*-*k* (k=1 to 11). The left and right ends of the conductive member 620 are respectively fitted into the left and right recesses 652 of the lower housing 600 and supported by the left and right recesses 652. The tip of the protrusion 63 of the conductive member 620 comes into contact with the straight portions 15*b* of the contacts 1*b*-2 (G), 1*b*-5 (G), 1*b*-7 (G), and 1*b*-10 (G) from above.

Figure 36:
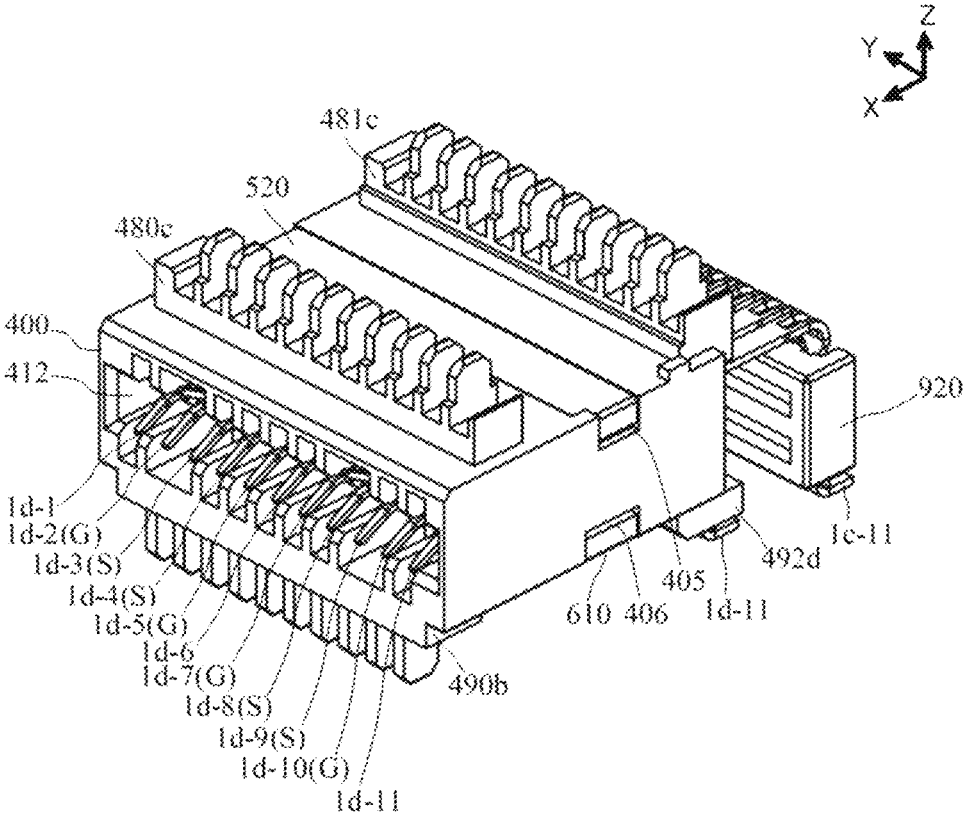
FIG. 36 is a view showing the positional relationship of the inner housing 400, the conductive member 520, the conductive member 610, and the alignment plate 920 in the high-speed transmission connector 6 of FIGS. 1 and 2.
Figure 37:
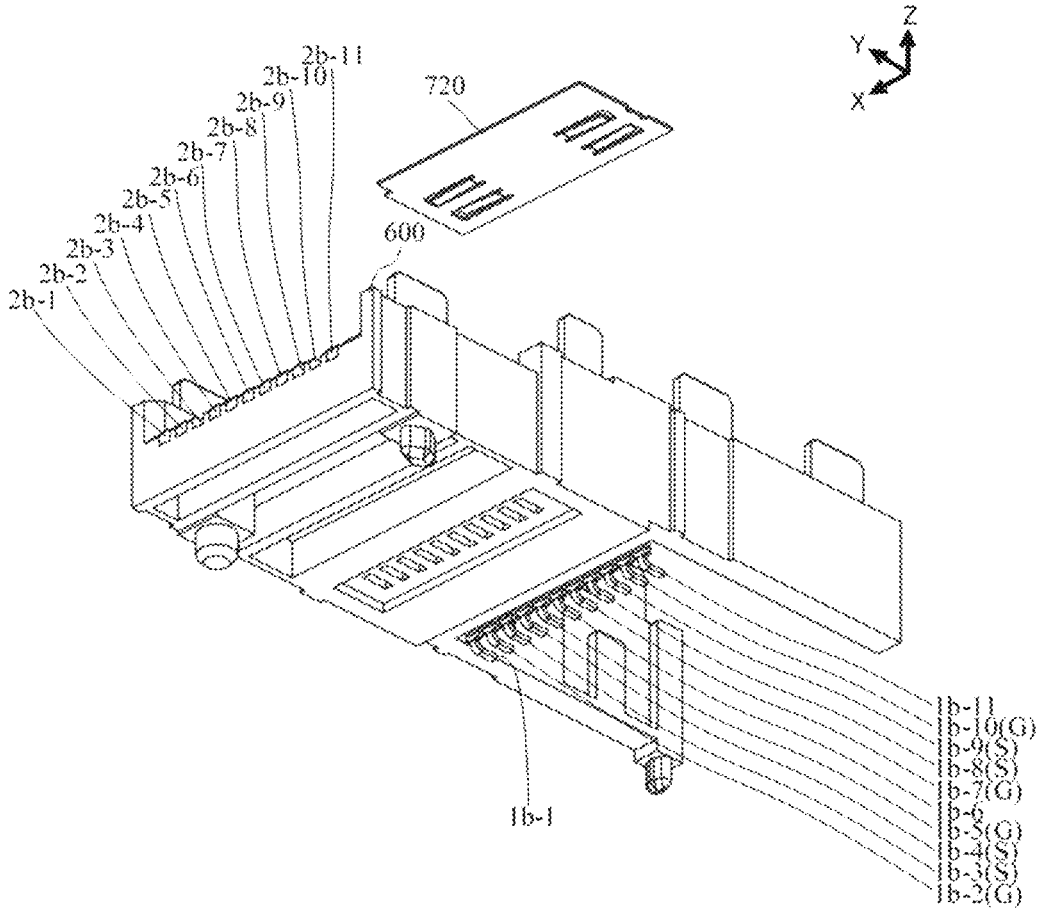
FIG. 37 is a view showing the positional relationship of the lower housing 600, the conductive member 620, and the shielding plate 720 in the high-speed transmission connector 6 of FIGS. 1 and 2.

As shown in FIG. 36, the straight portions 15*c* of the contacts 1*c*-*k* (k=1 to 11) are inserted into the through holes 4*c*-*k* (k=1 to 11) on the upper side of the inner housing 400. The tip side contact portions 11*c* of the contacts 1*c*-*k* (k=1 to 11) protrude below the upper groove in the opening 412. The straight portions 15*d* of the contacts 1*d*-*k* (k=1 to 11) are inserted into the through holes 4*d*-*k* (k=1 to 11) on the lower side of the inner housing 400. The tip side contact portions 11*d* of the contacts 1*d*-*k* (k=1 to 11) protrudes above the lower groove in the opening 412.

The conductive member 520 is fitted in the recess 405 of the inner housing 400. The projected portions 53 of the conductive member 520 pass through the slits 415 and reach the through holes 4*c*-2, 4*c*-5, 4*c*-7, and 4*c*-10, and the tips of the projected portions 53 come into contact with the straight portions 15*c* of the contacts 1*c*-2 (G), 1*c*-5 (G), 1*c*-7 (G), and 1*c*-10 (G) in the through holes 4*c*-2, 4*c*-5, 4*c*-7, and 4*c*-10 from above.

The conductive member 610 is fitted in the recess 406 of the inner housing 400. The projected portions 63 of the conductive member 610 pass through the slits 416 and reach the through holes 4*d*-2, 4*d*-5, 4*d*-7, 4*d*-10, and the tips of the projected portions 63 come into contact with the straight portions 15*d* of the contacts 1*d*-2 (G), 1*d*-5 (G), 1*d*-7 (G), and 1*d*-10 (G) in the through holes 4*d*-2, 4*d*-5, 4*d*-7, and 4*d*-10 from below.

As shown in FIGS. 3D and 3E, the shielding plate 710 is arranged between the conductive member 510 and the conductive member 520. The shielding plate 710 is located in the middle between the straight portion 15*a* of the contact 1*a*-*k* (k=1 to 11) and the straight portion 15*c* of the contact 1*c*-*k* (k=1 to 11), and is sandwiched between the conductive member 510 and the conductive member 520. The tip of the tilting plate portion 705 of the shielding plate 710 is in contact with the conductive member 510, and the tip of the tilting plate portion 706 of the shielding plate 710 is in contact with the conductive member 520. The left and right ends of the shielding plate 710 are fitted into the left and right recesses 515 of the upper housing 500 and supported by the left and right recesses 515.

The shielding plate 720 is arranged between the conductive member 610 and the conductive member 620. The shielding plate 720 is located in the middle between the straight portion 15*b* of the contact 1*b*-*k* (k=1 to 11) and the straight portion 15*d* of the contact 1*d*-*k* (k=1 to 11), and is sandwiched between the conductive member 610 and the conductive members 620. The tip of the tilting plate portion 705 of the shielding plate 720 is in contact with the conductive member 610, and the tip of the tilting plate portion 706 of the shielding plate 720 is in contact with the conductive member 620. The left and right ends of the shielding plate 720 are fitted into the left and right recesses 651 of the lower housing 600, and are supported by the left and right recesses 651.

The inner housing 400 is located between the stepped portion 502 of the upper housing 500 and the stepped portion 602 of the lower housing 600. The Alignment plates 810 and 920 are arranged between the left and right side plate portions 603 of the lower housing 600 on the rear side of the inner housing 400. The left and right ends of the alignment plate 810 are fitted into the left and right dents 681 of the lower housing 600 and supported by the left and right dents 681. The left and right ends of the alignment plate 920 are fitted into the left and right dents 692 of the lower housing 600 and are supported by the left and right dents 692.

The left and right ends of the inner housing 400 are fitted into the left and right recesses 650 of the lower housing 600 and supported by the left and right recesses 650. The lower end of the partition wall that separates the grooves of the convex portion 490*b* in the inner housing 400 is passed through the rectangular holes 690*b* of the lower housing 600 and heat-sealed into the rectangular holes 690*b*. The support plate 533 of the upper housing 500 is fitted into the recess 633 of the lower housing 600.

The support plate 533 of the upper housing 500 is fitted into the recess 633 of the lower housing 600 and is in contact with the upper end surface of the partition 680. The upper end of the support plate 642 of the lower housing 600 is passed through the rectangular holes 542 of the upper housing 500 and heat-sealed into the rectangular holes 542. The upper end of the support plate 643 of the lower housing 600 is passed through the rectangular holes 543 of the upper housing 500 and heat-sealed into the rectangular holes 543. The upper end of the support plate 644 of the lower housing 600 is passed through the rectangular holes 544 of the upper housing 500 and heat-sealed into the rectangular holes 544.

As shown in FIGS. 3D and 3E, the grooves 2*a*-*k* (k=1 to 11) of the upper housing 500 and the grooves 2*b*-*k* (k=1 to 11) of the lower housing 600 face each other in a vertical direction with a gap therebetween, and the gap between the grooves 2*a*-*k* (k=1 to 11) and the grooves 2*b*-*k* (k=1 to 11) and the opening 412 of the inner housing 400 on the rear side of the gap form the slot 40.

The tip side contact portions 11*a* of the contacts 1*a*-*k* (k=1 to 11) and the tip side contact portions 11*b* of the contacts 1*b*-*k* (k=1 to 11) face each other in a vertical direction on the front side in the slot 40. The tip side contact portions 11*c* of the contacts 1*c*-*k* (k=1 to 11) and the tip side contact portions 11*d* of the contacts 1*d*-*k* (k=1 to 11) face each other in a vertical direction at a further rearward position than the position where the tip side contact portions 11*c* of the contacts 1*c*-*k* (k=1 to 11) and the tip side contact portions 11*d* of the contacts 1*d*-*k* (k=1 to 11) face each other in the slot 40.

When the header 7 of the optical transceiver 5 is inserted into the slot 40 of the high-speed transmission connector 6, the ground pads GNDs on the upper surface of the header 7 come into contact with the tip side contact portion 11*a* of the contacts 1*a*-*k* (G) and the tip side contact portion 11*c* of the contacts 1*c*-*k* (G), and the signal pads SIGS come into contact with the tip side contact portions 11*a* of the contacts 1*a*-*k* (S) and the tip side contact portions 11*d* of the contacts 1*d*-*k* (S).

Further, the ground pads GND on the lower surface of the header 7 come into contact with the tip side contact portions 11*b* of the contacts 1*b*-*k* (G) and the tip side contact portion 11*d* of the contacts 1*d*-*k* (G), and the signal pads SIGs come into contact with the tip end side contact portions 11*b* of the contacts 1*b-k* (S) and tip end side contact portions 11*d* of the contacts 1*d-k* (S).

The rear parts of the straight portions 13*a* of the contacts 1*a-k* (k=1 to 11) press-fitted into the grooves 2*a-k* (k=1 to 11) of the upper housing 500 advances, along the stepped portion 502 of the upper housing 500, to a position above the alignment plate 810 on the rear side of the inner housing 400, hang down at this position, pass through the grooves 8*a-k* (k=1 to 11) of the alignment plate 810, and reaches the lower side of the gap 60 between the pair of side plate portions 603 of the lower housing 600.

The rear parts of the straight portion 13*b* of the contacts 1*b-k* (k=1 to 11) press-fitted into the grooves 2*b-k* (k=1 to 11) of the lower housing 600 hang down at a slightly further rearward position than the rear end of the stepped portion 602, and reach the lower side of the gap 60 of the lower housing 600.

The rear parts of the straight portions 15*c* of the contacts 1*c-k* (k=1 to 11) inserted into the through holes 4*c-k* (k=1 to 11) of the inner housing 400 advance to a position above the alignment plate 920 on the rear side of the inner housing 400, hang down at this position, pass through the grooves 9*c-k* (k=1 to 11) of the alignment plate 920, and reach the lower side of the gap 60 of the lower housing 600.

The rear parts of the straight portions 15*d* of the contacts 1*d-k* (k=1 to 11) inserted into the through hole 4*d-k* (k=1 to 11) of the inner housing 400 advance to a position above the grooves of the protrusion 492*d*, hang down at this position, pass through the grooves of the protrusion 492*d*, and reach the lower side of the gap 60 of the lower housing 600.

Below the gap 60 of the lower housing 600, the substrate side contact portions 17*b* of the contacts 1*b-k* (k=1 to 11), the substrate side contact portions 17*d* of the contacts 1*d-k* (k=1 to 11), and the substrate side contact portion 17*c* of the contacts 1*c-k* (k=1 to 11), and the substrate side contact portion 17*a* of contacts 1*a-k* (k=1 to 11) are spaced at the same interval in a longitudinal direction.

When the positioning bosses 671, 672, and 673 of the high-speed transmission connector 6 are inserted into positioning holes of an electronic substrate and the high-speed transmission connector 6 is mounted on the electronic substrate, substrate side contact portions 17*b* of the contacts 1*b-k* (k=1 to 11), substrate side contact portions 17*d* of the contacts 1*d-k* (k=1 to 11), substrate side contact portions 17*c* of the contacts 1*c-k* (k=1 to 11), and the substrate side contact portions 17*a* of the contacts 1*a-k* (k=1 to 11) come into contact with pads of the electronic substrate.

The details of the present embodiment are described above. The high-speed transmission connector 6 of the present embodiment includes the row of first contacts 1*a-k*, a row of second contacts 1*b-k*, the row of third contacts 1*c-k*, and the row of fourth contacts 1*d-k*, the upper housing 500 that supports the row of first contacts 1*a-k*, the lower housing 600 that supports the row of second contacts 1*b-k*, and the inner housing 400 that supports the row of third contacts 1*c-k* and the row of fourth contacts 1*d-k*. Further, the upper housing 500, the lower housing 600, and the inner housing 400 are assembled in such a manner that the upper housing 500 and the lower housing 600 face each other in a vertical direction with a gap therebetween, the inner housing 400 is accommodated in the two housings (i.e., upper housing 500 and the lower housing 600), and the gap forms a slot 400 into which the header 7 of the optical transceiver 5 as a communicating counterpart device is to be fitted. Therefore, according to the present embodiment, it is possible to provide a QSFP-DD high-speed transmission connector 6 which facilitates part assembling and has high dimensional stability and contact reliability.

Furthermore, in the high-speed transmission connector 6 of the present embodiment, the plurality of projected portions 53 of the conductive member 510 are in contact with the plurality of ground contacts 1*a-k* (G), and the plurality of ground contacts 1*a*-K (G) are electrically connected to each other via the conductive member 510. Also, the plurality of projected portions 53 of the conductive member 520 are in contact with the plurality of ground contacts 1*b-k* (G), and the plurality of ground contacts 1*b-k* (G) are electrically connected to each other via the conductive member 520. Also, the plurality of projected portions 63 of the conductive member 610 are in contact with the plurality of ground contacts 1*c-k* (G), and the plurality of ground contacts 1*c-k* (G) are electrically connected to each other via the conductive member 610. Also, the plurality of projected portions 63 of the conductive member 620 are in contact with the plurality of ground contacts 1*d-k* (G), and the plurality of ground contacts 1*d-k* (G) are electrically connected to each other via the conductive member 620. Therefore, according to the present embodiment, it is possible to provide the QSFP-DD high-speed transmission connector 6 in which ripple are less likely to occur in the frequency characteristics.

Further, in the high-speed transmission connector 6 of the present embodiment, the alignment plate 810 is arranged on the rear side of the inner housing 400 between the pair of side plate portions 603 of the lower housing 600, and the alignment plate 920 is arranged on the rear side of the inner housing 400 and on the front side of the alignment plate 810. Further, the rear parts of the straight portions of the contact 1*a-k* (k=1 to 11) press-fitted into the grooves 2*a-k* (k=1 to 11) of the upper housing 500 pass through the groove 8*a-k* (k=1 to 11) of the alignment plate 810 and reach the lower side of the gap 60 of the lower housing 600. Also, the rear parts of the straight portions 15*c* of the contacts 1*c-k* (k=1 to 11) inserted into the through holes 4*c-k* (k=1 to 11) of the upper housing 500 pass through the grooves 9*c-k* (k=1 to 11) of the alignment plate 920, and reaches the lower side of the gap 60 of the lower housing 600. Therefore, it is possible to provide the QSFP-DD high-speed transmission connector 6 in which the misalignment of the contacts is unlikely to occur.

Although the embodiment of the present invention has been described above, the following modifications may be added to this embodiment.

(1) In the above embodiment, the number of contacts constituting one row of contacts 1*a-k* (k=1 to 11), 1*b-k* (k=1 to 11), 1*c-k* (k=1 to 11), or 1*d-k* (k=1 to 11) may be 2 to 10, or 11 or more. The number of grooves constituting one row of grooves 2*a-k* (k=1 to 11) or 2*b-k* (k=1 to 11) may be 2 to 11, or more than 11.

(2) In the above embodiment, one or both of the alignment plate 810 and the alignment plate 920 may not be provided. Further, a third alignment plate different from the alignment plate 810 and the alignment plate 920 may be arranged and configured such that the rear parts of the straight portions of the contacts 1*b-k* (k=1 to 11) press-fitted in the grooves 2*a-k* (k=1 to 11) of the upper housing 500 advances to a position on the upper side of the third alignment plate, hang down at this position, pass through grooves of the third alignment plate, and reach the lower side of the gap 60 of the lower housing 600.

(3) In the above embodiment, the plurality of projected portions 53 of the conductive member 510, the plurality of projected portions 53 of the conductive member 520, the plurality of projected portions 63 of the conductive member 610, and the plurality of projected portions 63 of the conductive member 620 do not need to be in contact with the plurality of ground contacts 1*a-k* (G), 1*b-k* (G), 1*c-k* (G) and 1*d-k* (G), may only be arranged close to the plurality of ground contacts 1*a-k* (G), 1*b-k* (G), 1*c-k* (G) and 1*d-k* (G). In brief, it is sufficient that the plurality of projected portions 53 of the conductive member 510, the plurality of projected portions 53 of the conductive member 520, the plurality of projected portions 63 of the conductive member 610, and the plurality of projected portions 63 of the conductive member 620 be electrically connected to the plurality of ground contacts 1*a-k* (G), 1*b-k* (G), 1*c-k* (G), and 1*d-k* (G).

What is claimed is:

1. A high-speed transmission connector, comprising:

a row of first contacts;

a row of second contacts;

a row of third contacts;

a row of fourth contacts;

an upper housing that supports the row of first contacts;

a lower housing that supports the row of second contacts; and an inner housing substantially in a shape of a rectangular body that supports both of the row of third contacts and the row of fourth contacts, and is provided with an opening on a front surface thereof; wherein the upper housing and the lower housing face each other in a vertical direction with a gap therebetween, and the inner housing is accommodated in the gap; and the gap and the opening forming a slot into which a header of an external device as a communicating counterpart is to be fitted.

2. The high-speed transmission connector according to claim 1, wherein the upper housing comprises a row of first grooves, each of which extends longitudinally and which are arranged laterally, the lower housing comprises a row of second grooves, each of which extends longitudinally and which are arranged laterally, the inner housing comprises a row of first holes and a row of second holes, each of which extends longitudinally and which are vertically divided, the holes in each row being arranged laterally, the first contacts are press-fitted into the first grooves, the second contacts are press-fitted into the second grooves, the third contacts are inserted into the first holes, and the fourth contacts are inserted into the second holes.

3. The high-speed transmission connector according to claim 2, wherein a contact portion of the first contact that contacts a header of an external device as a communicating counterpart and a contact portion of the second contact that contacts the header of the external device as a communicating counterpart face each other in a vertical direction in the slot, and a contact portion of the third contact that contacts the header of the external device as a communicating counterpart and a contact portion of the fourth contact that contacts the header of the external device as a communicating counterpart face each other in a vertical direction in the slot on the further rear side than a position where the contact portion of the first contact and the contact portion of the second contact face each other.

4. The high-speed transmission connector according to claim 2, wherein the plurality of first contacts press-fitted into the grooves in the row of the first grooves comprise a plurality of first ground contacts and a plurality of first signal contacts, the high-speed transmission connector further comprises a first conductive member comprising a horizontal plate portion extending laterally and a plurality of protrusions rising from one surface of the horizontal plate portion, and the plurality of protrusions of the first conductive member are in contact with or electrically connected to the plurality of first ground contacts.

5. The high-speed transmission connector according to claim 4, wherein the plurality of third contacts inserted into the holes in the row of first holes comprise a plurality of third ground contacts and a plurality of third signal contacts, the high-speed transmission connector further comprises a third conductive member comprising a horizontal plate portion extending laterally and a plurality of protrusions rising from one surface of the horizontal plate portion, and the plurality of protrusions of the third conductive member are in contact with or electrically connected to the plurality of third ground contacts.

6. The high-speed transmission connector according to claim 5, wherein the first conductive member is arranged below the first contacts, the third conductive member is arranged above the third contacts, and a first shielding plate is arranged between the first conductive member and the third conductive member.

7. The high-speed transmission connector according to claim 2, wherein the plurality of second contacts press-fitted into the grooves in the row of second grooves comprise a plurality of second ground contacts and a plurality of second signal contacts, the high-speed transmission connector further comprises a second conductive member comprising a horizontal plate portion extending laterally and a plurality of protrusions rising from one surface of the horizontal plate portion, and the plurality of protrusions of the second conductive member are in contact with or electrically connected to the plurality of second ground contacts.

8. The high-speed transmission connector according to claim 7, wherein the plurality of fourth contacts inserted into each hole in the row of second holes comprise a plurality of fourth ground contacts and a plurality of fourth signal contacts, the high-speed transmission connector further comprises a fourth conductive member comprising a horizontal plate portion extending laterally and a plurality of protrusions rising from one surface of the horizontal plate portion, and the plurality of protrusions of the fourth conductive member are in contact with or electrically connected to the plurality of fourth ground contacts.

9. The high-speed transmission connector according to claim 8, wherein the second conductive member is arranged above the second contacts, the fourth conductive member is arranged below the fourth contact, and a second shielding plate is arranged between the second conductive member and the fourth conductive member.

10. The high-speed transmission connector according to claim 2, wherein the lower housing comprises a pair of side plate portions facing each other in a lateral direction with the inner housing therebetween, a first alignment plate comprising a row of grooves recessed in a comb blade shape is arranged on the rear side of the inner housing between the pair of side plate portions, and a rear part of a straight portion of the first contact press-fitted into the first groove of the upper housing is advanced to a position above the first alignment plate at which the rear part is hanged down, passes through the groove of the first alignment plate, and reaches a lower side of a gap between the pair of side plate portions of the lower housing.

11. The high-speed transmission connector according to claim 10, wherein a second alignment plate comprising a row of grooves recessed in a comb blade shape is arranged on the rear side of the inner housing between the pair of side plate portions and on the front side of the first alignment plate, a rear part of a straight portion of the third contact inserted into the first hole of the inner housing is advanced to a position above the second alignment plate at which the rear part is hanged down, passes through the groove of the second alignment plate, and reaches the lower side of the gap between the pair of side plate portions of the lower housing.

* * * * *